US008763827B2

(12) United States Patent
Cohn

(10) Patent No.: US 8,763,827 B2
(45) Date of Patent: Jul. 1, 2014

(54) BABY NIPPLE ASSEMBLY FOR USE WITH FLEXIBLE DRINK POUCHES

(76) Inventor: William E. Cohn, Bellaire, TX (US)

( * ) Notice: Subject to any disclaimer, the term of this patent is extended or adjusted under 35 U.S.C. 154(b) by 155 days.

(21) Appl. No.: 12/927,501

(22) Filed: Nov. 16, 2010

(65) Prior Publication Data

US 2011/0240587 A1 Oct. 6, 2011

Related U.S. Application Data

(63) Continuation of application No. 10/948,047, filed on Sep. 23, 2004, now Pat. No. 7,832,576.

(60) Provisional application No. 60/505,359, filed on Sep. 23, 2003, provisional application No. 60/530,417, filed on Dec. 17, 2003.

(51) Int. Cl.
*A61J 11/04* (2006.01)

(52) U.S. Cl.
USPC ..... 215/11.3; 215/11.1; 220/714; 383/80; 426/117

(58) Field of Classification Search
USPC ..... 215/11.3, 11.1, 11.4; 383/66, 80, 38; 426/117; 220/714
See application file for complete search history.

(56) References Cited

U.S. PATENT DOCUMENTS 3,134,494 A 5/1964 Quinn
3,255,923 A 6/1966 Soto
3,266,910 A 8/1966 Bamby
3,991,912 A 11/1976 Soto
4,706,827 A 11/1987 Cabernoch et al.
4,801,007 A 1/1989 Rule
4,830,205 A 5/1989 Hammond et al.
4,867,324 A 9/1989 Rogosich et al.
4,946,040 A 8/1990 Ipenburg
5,273,171 A 12/1993 Steele-Rowland et al.
5,549,389 A 8/1996 Takagaki et al.
6,551,639 B1 4/2003 Nye et al.
6,592,918 B2 7/2003 Kaeser
6,598,757 B2 7/2003 Stillinger et al.
6,651,845 B1 11/2003 Schroeder
6,669,013 B1 12/2003 Villanueva
6,883,683 B1 4/2005 Cunningham et al.
6,991,121 B1 1/2006 Kipperman et al.

FOREIGN PATENT DOCUMENTS

WO WO 85/04574 10/1985

*Primary Examiner* — Sue A Weaver
(74) *Attorney, Agent, or Firm* — Pandiscio & Pandiscio

(57) ABSTRACT

A novel baby nipple assembly for use with a flexible drink pouch, wherein the baby nipple assembly generally comprises a mount subassembly (sometimes hereinafter referred to as simply "the mount" or "the disk") for attachment to the flexible drink pouch, and a nipple subassembly (sometimes hereinafter referred to as simply "the nipple") for connection to the mount subassembly, wherein the mount subassembly comprises a relatively large flat element for adhesion to an outside surface of the flexible drink pouch, and the nipple subassembly comprises (i) means for connection to the mount subassembly, (ii) a sharp tube for extending through the mount subassembly and puncturing the side wall of the flexible drink pouch, and (iii) a soft nipple in fluid communication with the sharp tube, whereby a baby or young child can suckle on the nipple and receive the beverage from the flexible drink pouch.

16 Claims, 33 Drawing Sheets

BABY NIPPLE ASSEMBLY FOR USE WITH FLEXIBLE DRINK POUCHES

REFERENCE TO PENDING PRIOR PATENT APPLICATIONS

This patent application is a continuation of prior U.S. patent application Ser. No. 10/948,047, now U.S. Pat. No. 7,832,576, filed Sep. 23, 2004 by William E. Cohn for BABY NIPPLE ASSEMBLY FOR USE WITH FLEXIBLE DRINK POUCHES, which in turn claims benefit of:

(1) prior U.S. Provisional Patent Application Ser. No. 60/505,359, filed Sep. 23, 2003 by William E. Cohn for BABY NIPPLE ASSEMBLY FOR USE WITH FLEXIBLE DRINK POUCHES; and (2) prior U.S. Provisional Patent Application Ser. No. 60/530,417, filed Dec. 17, 2003 by William E. Cohn for BABY NIPPLE ASSEMBLY FOR USE WITH FLEXIBLE DRINK POUCHES.

The above-identified patent applications are hereby incorporated herein by reference.

FIELD OF THE INVENTION

This invention relates to baby nipple assemblies in general, and more particularly to a novel baby nipple assembly for use with flexible drink pouches.

BACKGROUND OF THE INVENTION

Baby nipple assemblies are well known for permitting babies and young toddlers to drink from a bottle by suckling. These baby nipple assemblies typically comprise a soft rubber nipple for suckling, with the nipple being releasably secured to the mouth of the bottle by a screw-on cap. More particularly, the cap typically has a hole in its center for allowing the nipple to protrude from the cap, with the cap securing a flange formed on the back end of the nipple to the top rim of the bottle. This design has proven highly advantageous, since it allows for easy access to the interior of the bottle for refilling, it allows for easy disassembly for cleaning, it allows a worn out or damaged rubber nipple to be replaced separately from the bottle and cap, etc. As a result, baby nipple assemblies of the sort described above are in widespread use throughout much of the world.

In recent years, it has become common for beverage providers, and particularly fruit drink providers, to package their beverages in a flexible drink pouch. More particularly, with this arrangement, a single beverage serving is packaged in a flexible drink pouch, and a straw (contained in a disposable wrapper) is releasably secured to the exterior of the package. The straw is provided with a sharp tip on one end, and the flexible drink pouch is provided with a target puncture zone near its top end. In use, the user detaches the straw from the exterior of the flexible drink pouch, removes the straw from its wrapper, pokes the sharp end of the straw through the side wall of the flexible drink pouch, and then drinks from the flexible drink pouch with a sucking action. In addition, the user can simultaneously squeeze the side walls of the flexible drink pouch during use, so as to help force fluid up through the straw and into the user's mouth.

Such an arrangement has proven to be quite popular, inasmuch as it provides a simple, inexpensive and space-saving way to package, store, transport and utilize beverages, particularly in single-serving quantities.

Unfortunately, however, these flexible drink pouches suffer from several drawbacks. Among these is the problem that the user must be old enough to drink from a straw. Thus, children needing to drink with a nipple (e.g., infants and very young toddlers) generally cannot drink from such a flexible drink pouch. Furthermore, once the straw has been inserted into the flexible drink pouch, it takes a fair amount of manual dexterity to securely hold the flexible drink pouch in one's hand without inadvertently causing the beverage to "shoot out" the end of the straw. Thus, many young toddlers cannot use these flexible drink pouches without spilling the beverage. Furthermore, even if the toddler is old enough to be able to drink from the flexible drink pouch without spilling, or is in a location (e.g., the beach) where spilling may be acceptable, it can still be unsafe to leave the child unattended with the flexible drink pouch, since the straw constitutes a sharp object which could cause injury to the child or to another nearby child.

SUMMARY OF THE INVENTION

As a result, one object of the present invention is to provide a novel baby nipple assembly for use with flexible drink pouches, whereby a baby or toddler will be able to drink from a flexible drink pouch using a nipple.

Another object of the present invention is to provide a novel method for drinking from a flexible drink pouch.

These and other objects are addressed by the present invention, which comprises a novel baby nipple assembly for use with a flexible drink pouch, wherein the baby nipple assembly generally comprises a mount subassembly (sometimes hereinafter referred to as simply "the mount" or "the disk") for attachment to the flexible drink pouch, and a nipple subassembly (sometimes hereinafter referred to as simply "the nipple") for connection to the mount subassembly, wherein the mount subassembly comprises a relatively large flat element for adhesion to an outside surface of the flexible drink pouch, and the nipple subassembly comprises (i) means for connection to the mount subassembly, (ii) a sharp tube for extending through the mount subassembly and puncturing the side wall of the flexible drink pouch, and (iii) a soft nipple in fluid communication with the sharp tube, whereby a baby or young child can suckle on the nipple and receive the beverage from the flexible drink pouch.

In another form of the invention, there is provided a drink assembly comprising:

a mount subassembly for attachment to a pre-existing flexible drink pouch, the mount subassembly comprising a body having a proximal side and a distal side and an opening extending from the proximal side to the distal side, and an adhesive mounted on the distal side for affixing the mount subassembly to the flexible drink pouch; and a mouthpiece subassembly for releasable attachment to the mount subassembly, the mouthpiece subassembly comprising a mouthpiece having an opening therein, and a tube extending distally from the mouthpiece, with the interior of the tube communicating with the opening in the mouthpiece.

In another form of the invention, there is provided a method for drinking from a flexible drink pouch, comprising:

attaching a mount subassembly to a pre-existing flexible drink pouch by pressing an adhesive-coated surface against the flexible drink pouch, wherein the mount subassembly comprises an opening therethrough; and attaching a mouthpiece subassembly to the mount subassembly, the mouthpiece subassembly comprising a mouthpiece having an opening therein, and a tube extending distally from the mouthpiece, with the tube extending through the opening in the mount subassembly and into the interior of the flexible drink pouch.

In another form of the invention, there is provided a drink assembly comprising:

a mount subassembly attached to a pre-existing flexible drink pouch, the mount subassembly comprising a body having a proximal side and a distal side and an opening extending from the proximal side to the distal side, with the distal side of the mount subassembly being fixed to the flexible drink pouch; and a mouthpiece subassembly for releasable attachment to the mount subassembly, the mouthpiece subassembly comprising a mouthpiece having an opening therein, and a tube extending distally from the mouthpiece, with the interior of the tube communicating with the opening in the mouthpiece.

In another form of the invention, there is provided a method for drinking from a flexible drink pouch, comprising:

providing a pre-existing flexible drink pouch having a mount subassembly attached thereto, wherein the mount subassembly comprises an opening therethrough; and attaching a mouthpiece subassembly to the mount subassembly, the mouthpiece subassembly comprising a mouthpiece having an opening therein, and a tube extending distally from the mouthpiece, with the tube extending through the opening in the mount subassembly and into the interior of the flexible drink pouch.

In another form of the invention, there is provided a drink assembly comprising:

a mount subassembly for attachment to a pre-existing container, the mount subassembly comprising a body having a proximal side and a distal side and an opening extending from the proximal side to the distal side, and an adhesive mounted on the distal side for affixing the mount subassembly to the container; and a mouthpiece subassembly for releasable attachment to the mount subassembly, the mouthpiece subassembly comprising a mouthpiece having an opening therein, and a tube extending distally from the mouthpiece, with the interior of the tube communicating with the opening in the mouthpiece.

In another form of the invention, there is provided a method for drinking from a pre-existing container, comprising:

attaching a mount subassembly to the pre-existing container by pressing an adhesive-coated surface against the pre-existing container, wherein the mount subassembly comprises an opening therethrough; and attaching a mouthpiece subassembly to the mount subassembly, the mouthpiece subassembly comprising a mouthpiece having an opening therein, and a tube extending distally from the mouthpiece, with the tube extending through the opening in the mount subassembly and into the interior of the pre-existing container.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts and further wherein:

FIGS. 16A-23 are a series of views showing an alternative form of baby nipple assembly incorporating a Heimlich-type valve;

DETAILED DESCRIPTION OF THE PREFERRED EMBODIMENTS

Figure 1:
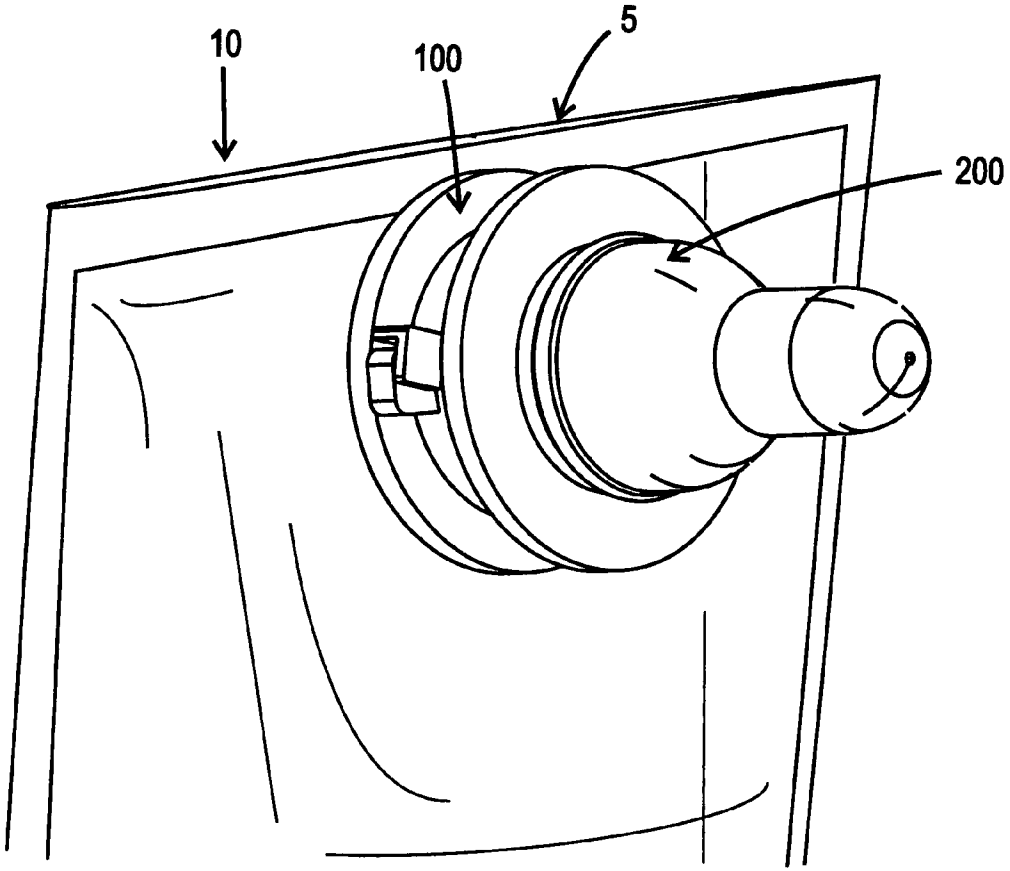
FIG. 1 is a perspective view showing the novel baby nipple assembly attached to a flexible drink pouch.

Looking now at FIG. 1, there is shown a novel baby nipple assembly 5 for use with a flexible drink pouch 10. Baby nipple assembly 5 generally comprises a mount subassembly (or "mount" or "disc") 100 and a nipple subassembly (or "nipple") 200.

Figure 2:
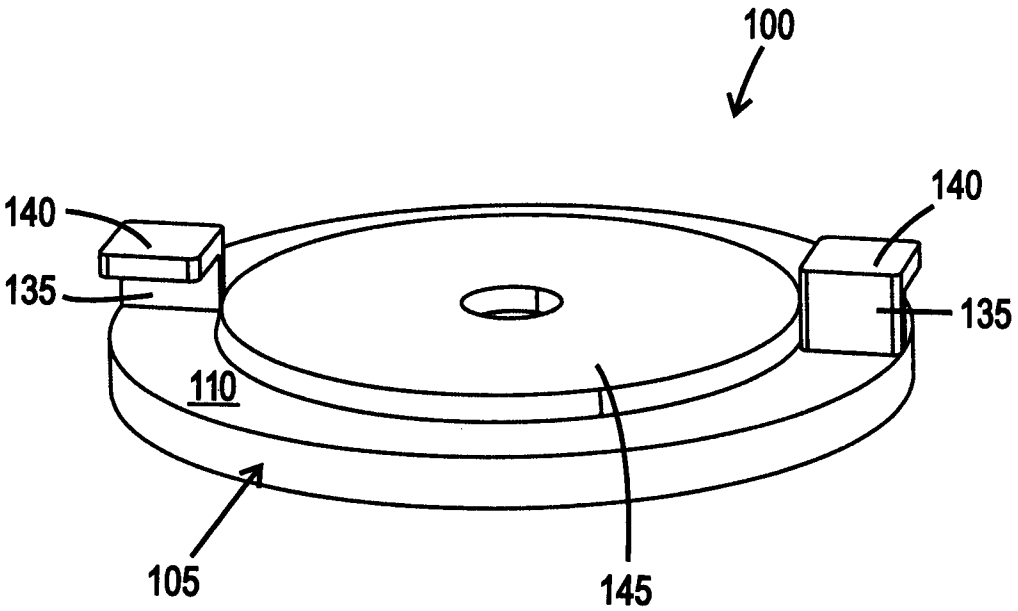
FIGS. 2-4 are views showing further details of the baby nipple assembly's mount subassembly.
Figure 3:
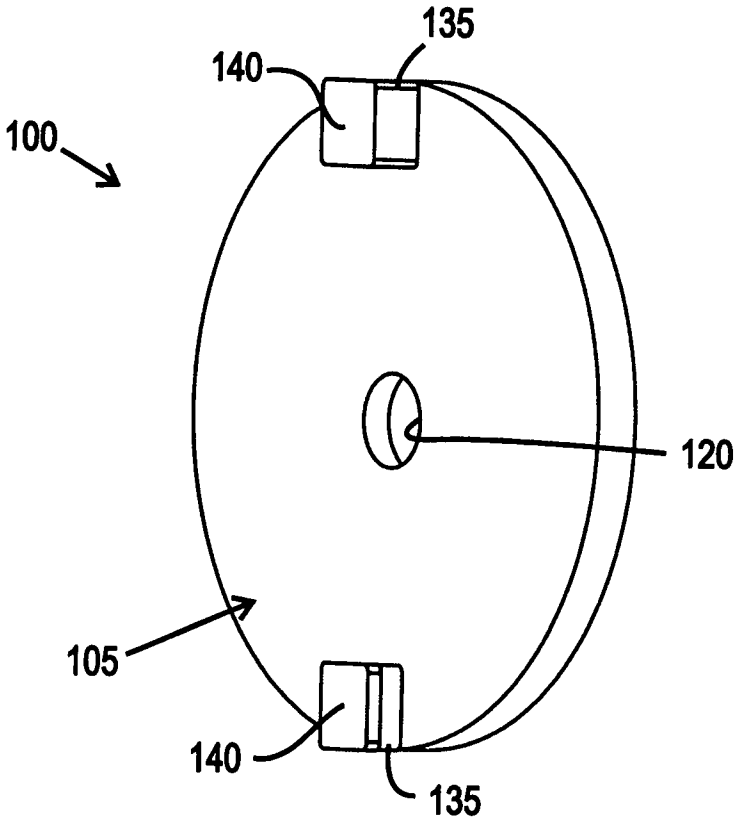
Figure 4:
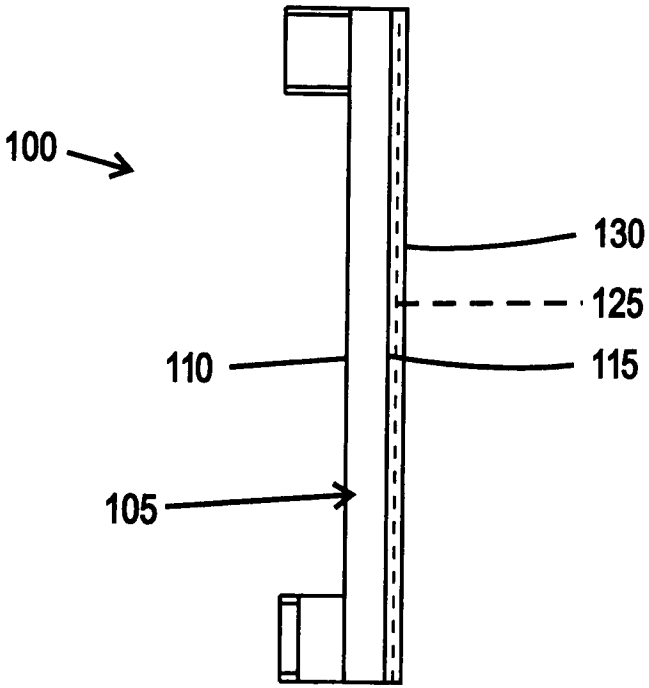
Figure 5:
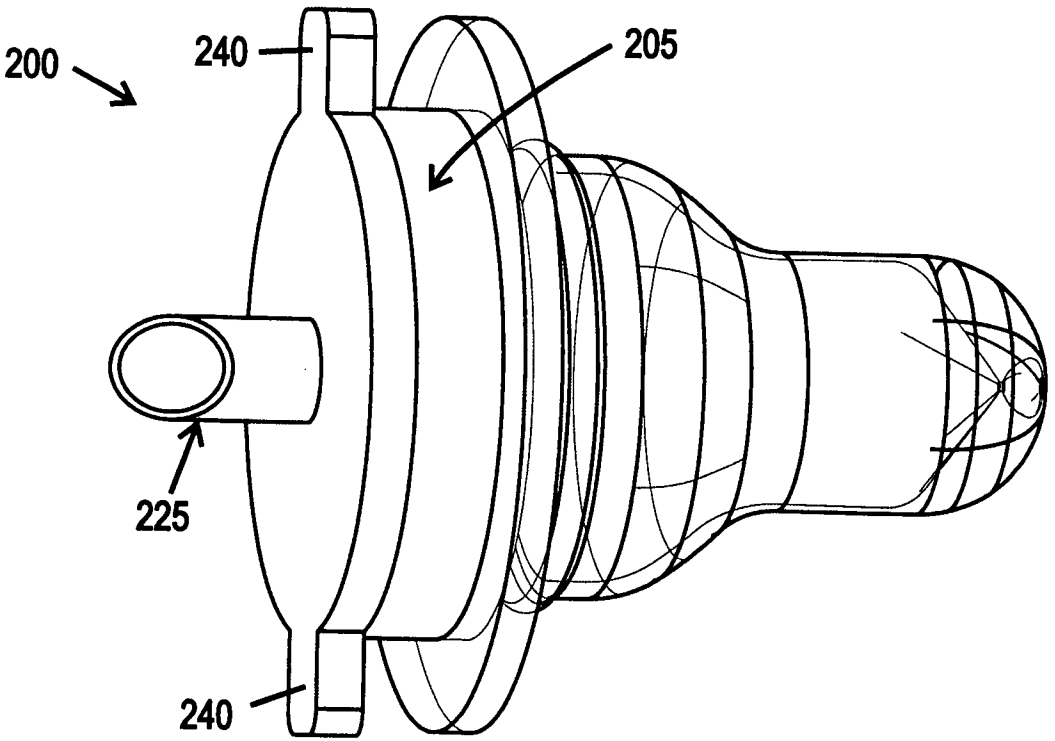
FIGS. 5-8 are views showing further details of the baby nipple assembly's nipple subassembly.
Figure 6:
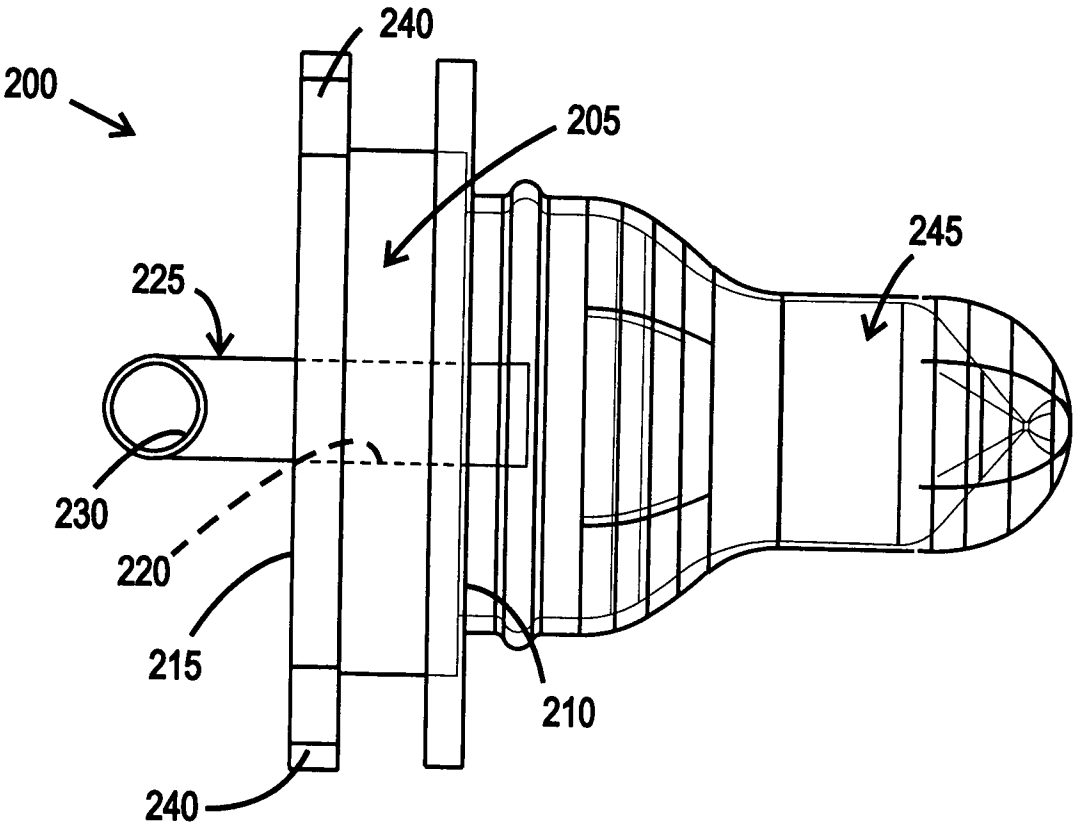
Figure 7:
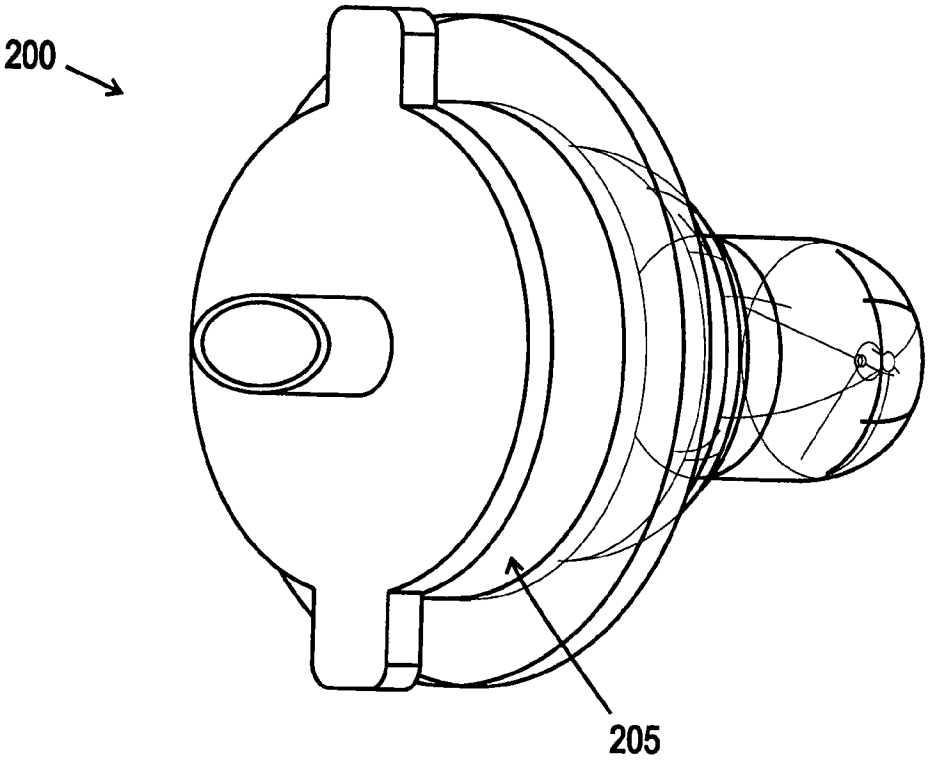
Figure 8:
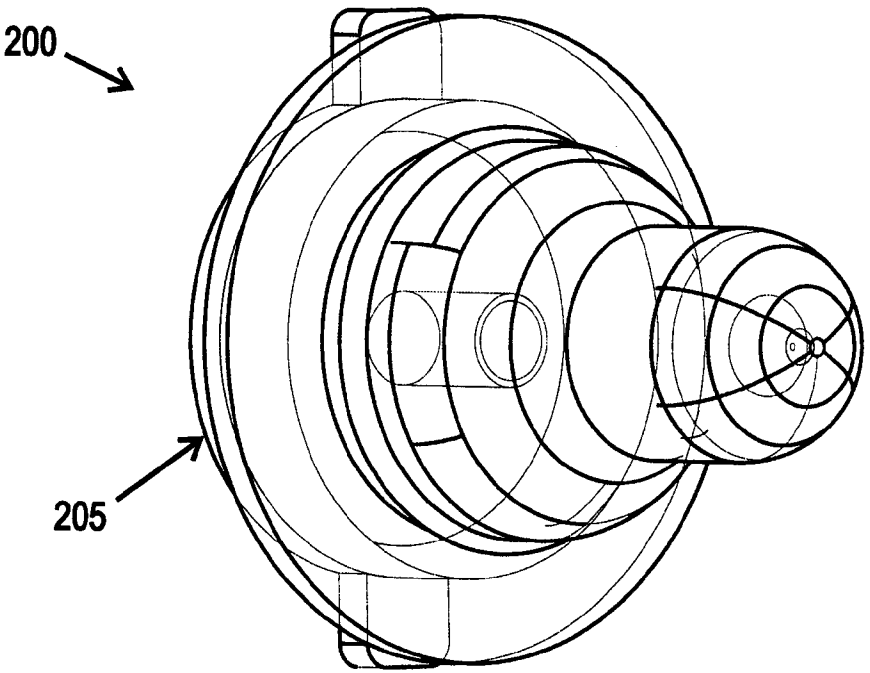
Figure 9:
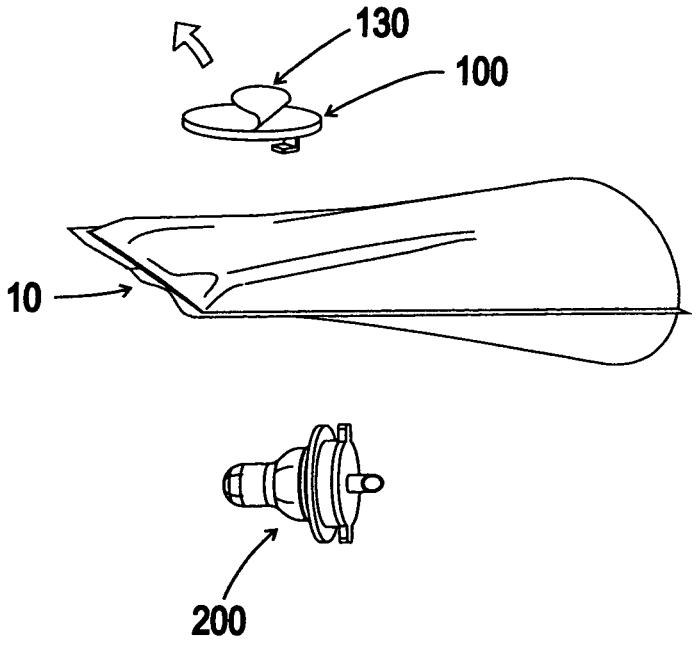
FIGS. 9-16 are a series of views showing the baby nipple assembly being attached to a flexible drink pouch.
Figure 10:
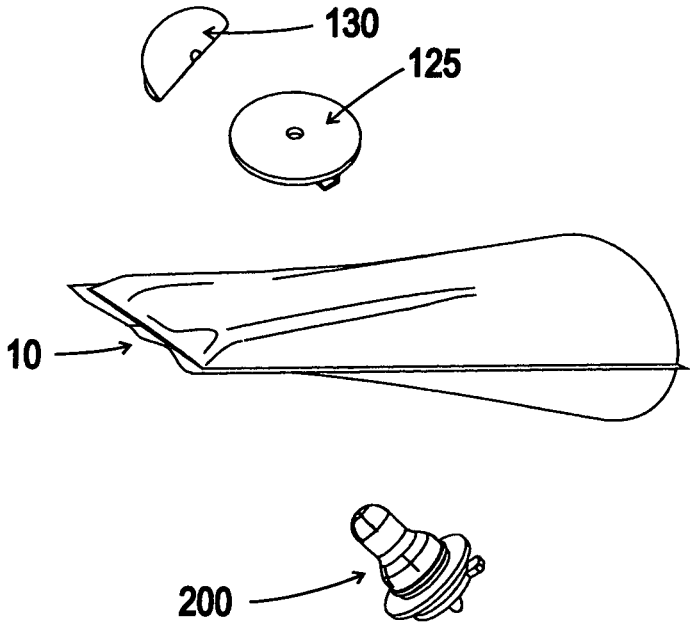

Mount subassembly 100 is shown in further detail in FIGS. 2-4. Mount subassembly 100 generally comprises a body 105 having a front side 110 and a rear side 115, and a center hole 120 extending between front side 110 and rear side 115. An adhesive 125 is positioned on rear side 115 and covered by a peel-away layer 130. A pair of posts 135 extend away from front side 110. Each post 130 has a flange 140 attached thereto.

Body 105 preferably includes a relatively soft surface on its front side 110 so as to facilitate sealing with nipple subassembly 200, as will hereinafter be discussed. This relatively soft surface may be formed as part of body 105, or as a separate element incorporated into body 105, or it may constitute a separate member adhered to front side 110, e.g., such as a seal 145 shown in FIG. 2.

Nipple subassembly 200 is shown in more detail in FIGS. 5-8. Nipple subassembly 200 comprises a body 205 having a front side 210 and a rear side 215. An opening 220 extends from front side 210 to rear side 215. A tube 225, having a lumen 230, extends rearwardly from rear side 215. Tube 225 is mounted to body 205 so that lumen 230 is in fluid communication with opening 220. The rear end of tube 225 is preferably sharpened as shown as FIG. 5, whereby tube 225 can be forced through the side wall of a flexible drink pouch, as will hereinafter be discussed.

A pair of flanges 240 extend laterally outwardly from body 205. Flanges 240 engage with flanges 140 of mount subassembly 100, as will hereinafter be described, so that nipple subassembly 200 may be secured to mount subassembly 100. A nipple 245 is secured to the front side 210 of body 205 so that the interior of the nipple is in fluid communication with opening 220, whereby fluid passing through opening 220 will be delivered to the interior of nipple 245.

Figure 11:
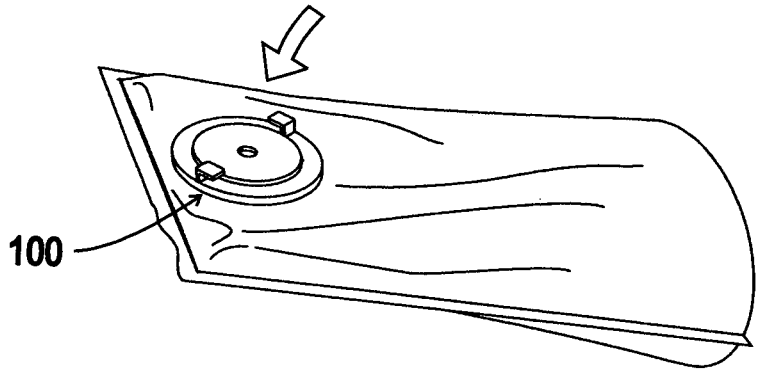
Figure 12:
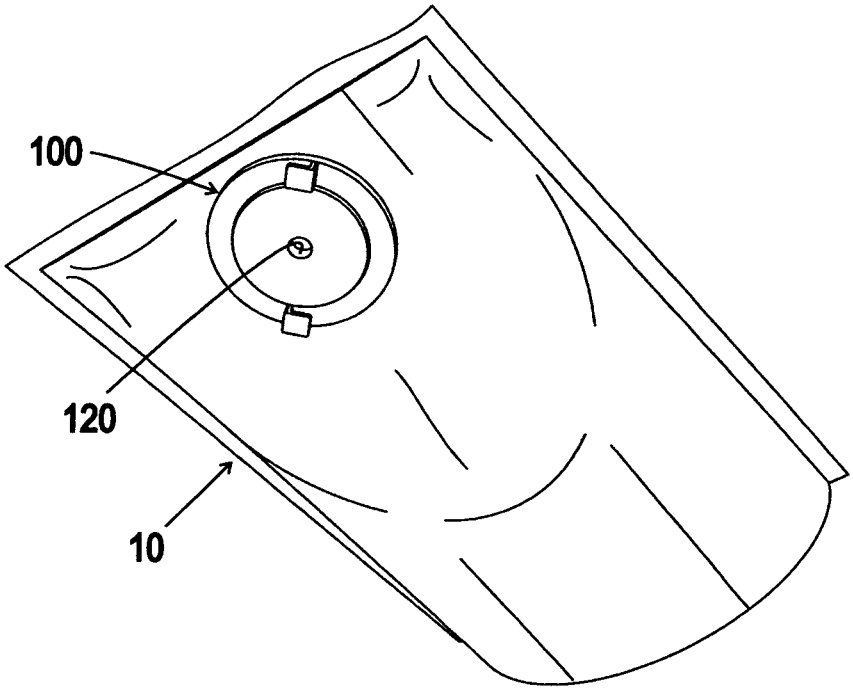

In use, and looking now at FIGS. 9-16, mount subassembly 100 is first attached to the flexible drink pouch 10. This is done by removing the peel away layer 130 (FIGS. 9 and 10) so as to expose adhesive 125, and then pressing the rear side 115 of mount subassembly 100 against the side wall of flexible drink pouch 10 (FIGS. 11 and 12). As this is done, flexible drink pouch 10 is preferably squeezed slightly by the user, so as to provide a firm, relatively flat surface for receiving mount subassembly 100. To the extent that flexible drink pouch 10 includes a puncture target zone (e.g., a wall region specifically configured to facilitate puncturing), the center hole 120 of mount subassembly 100 is preferably aligned with such a puncture target zone during attachment of mount subassembly 100 to flexible drink pouch 10.

Alternatively, mount subassembly 100 may be pre-attached to flexible drink pouch 10, e.g., at the time of manufacture.

Figure 13:
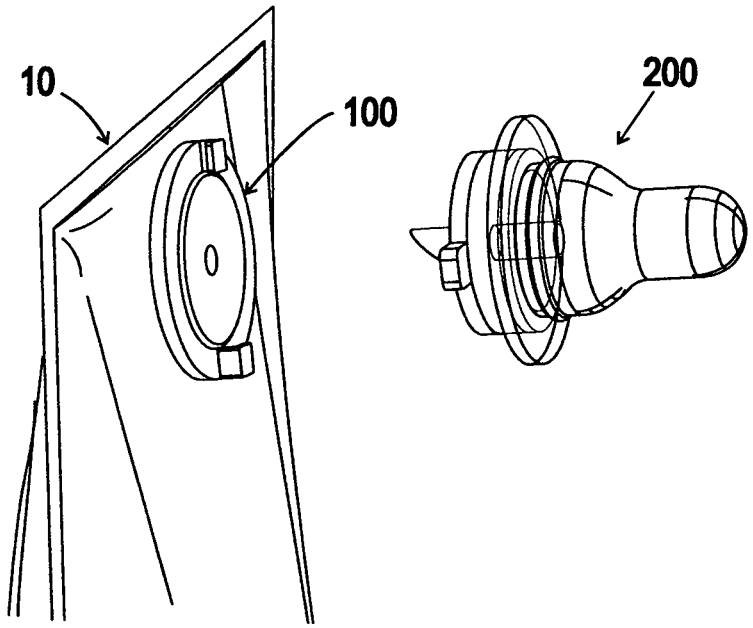
Figure 14:
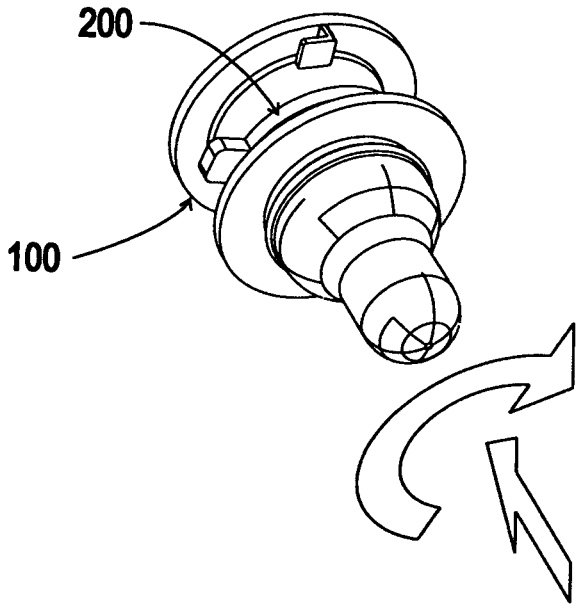
Figure 15:
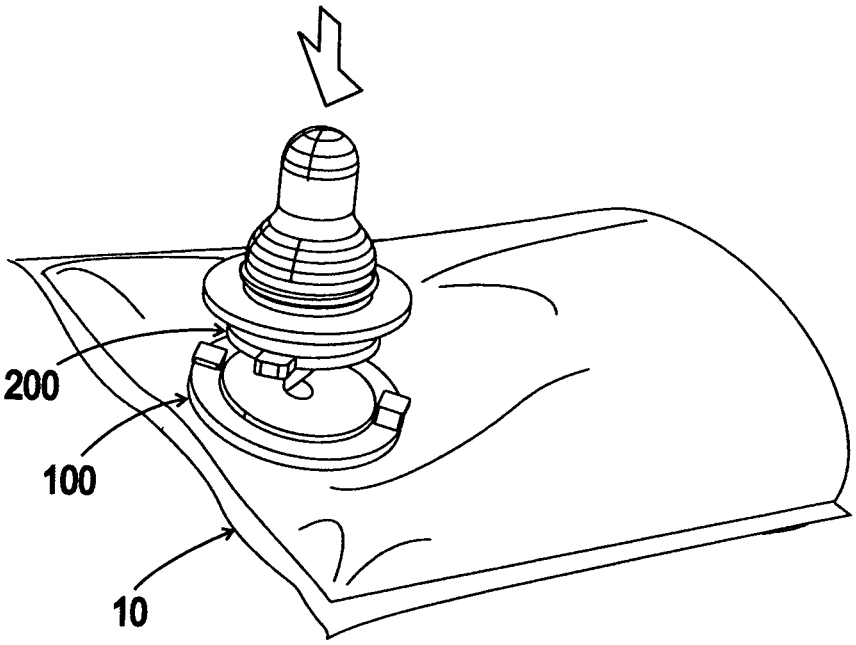
Figure 16:
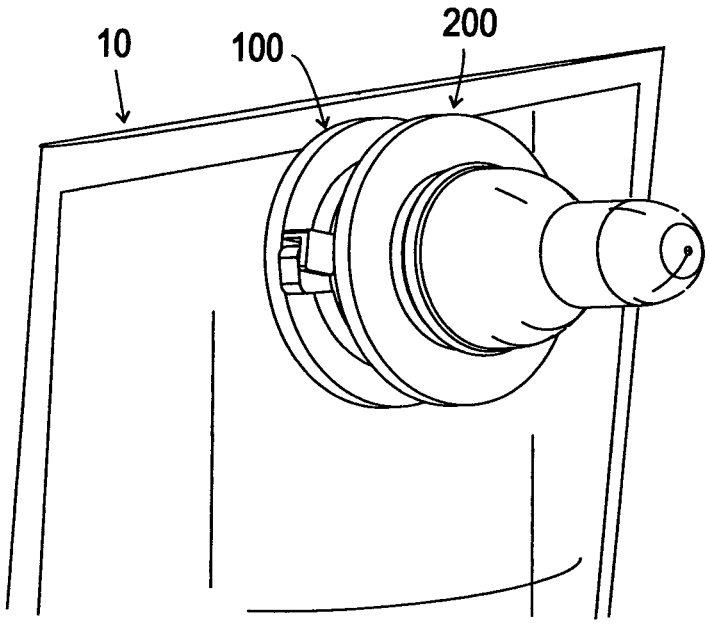
Figure 16A:
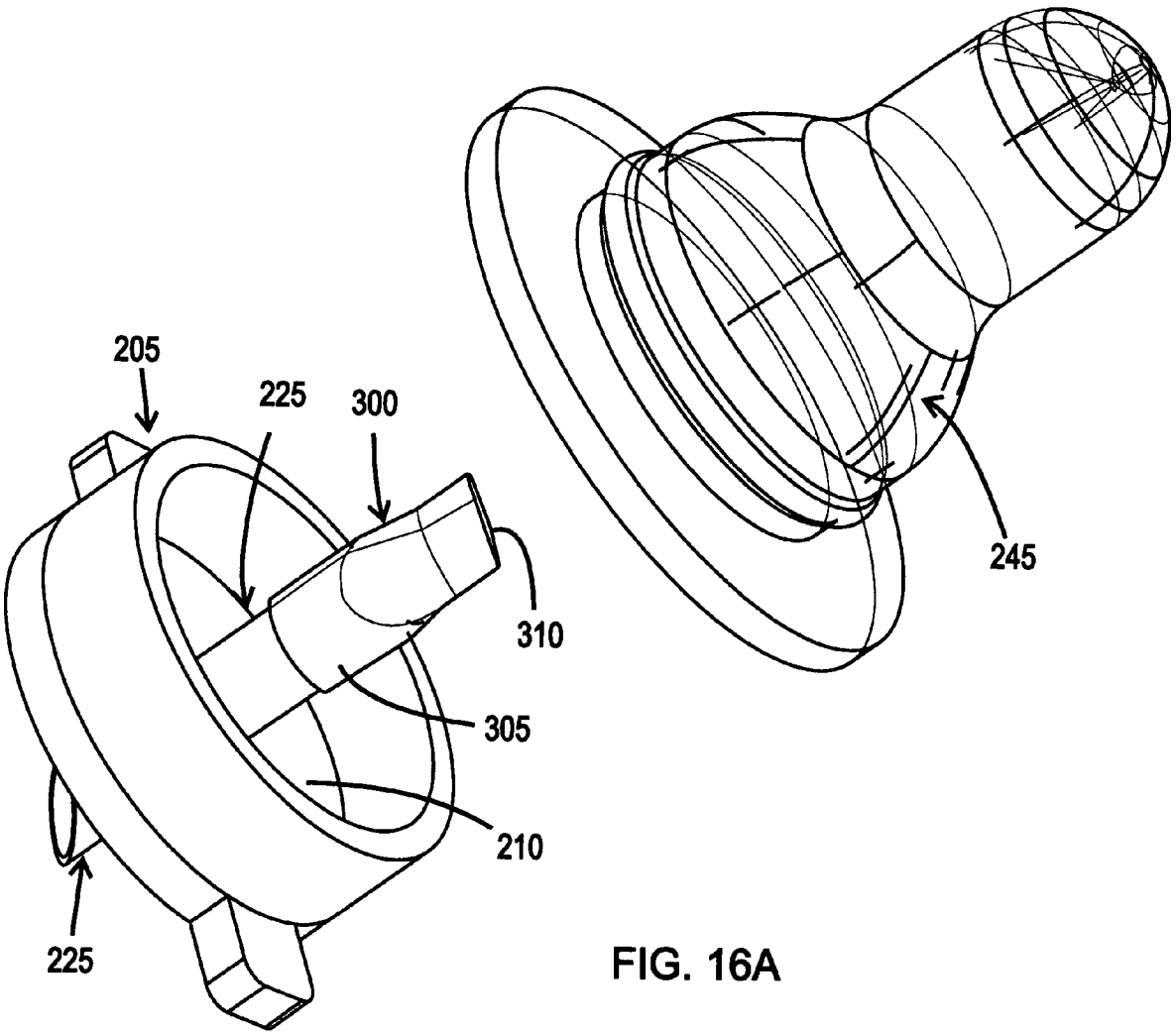
Figure 17:
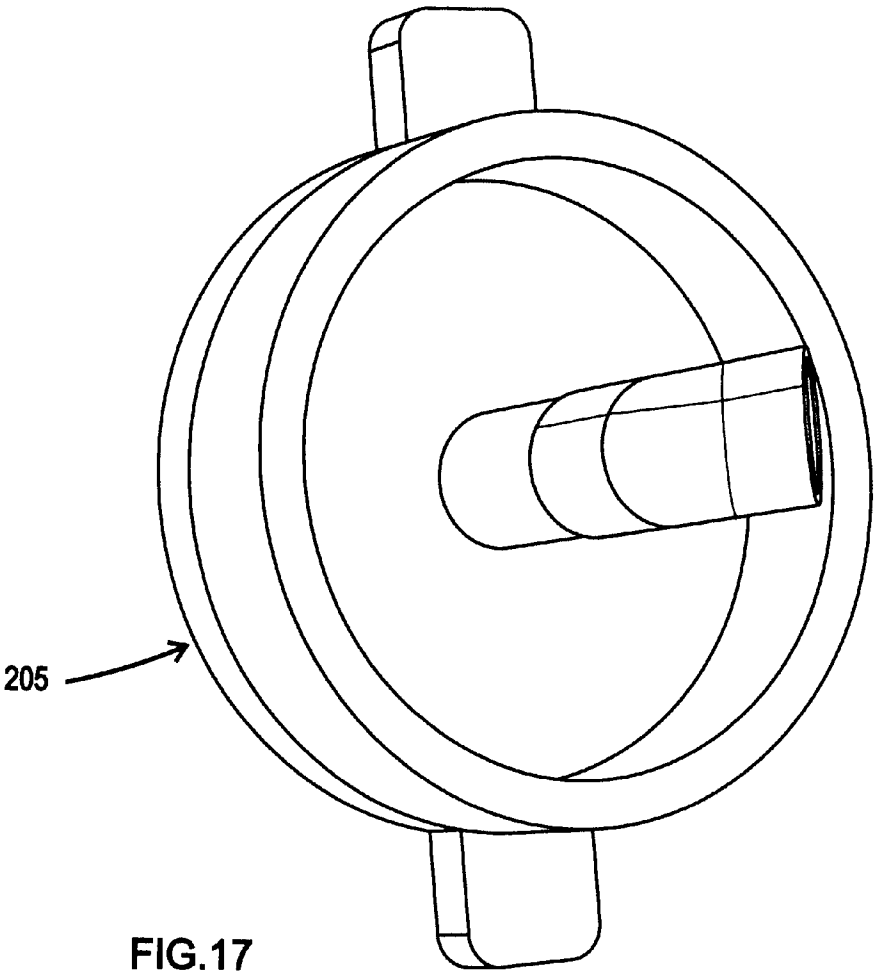
Figure 18:
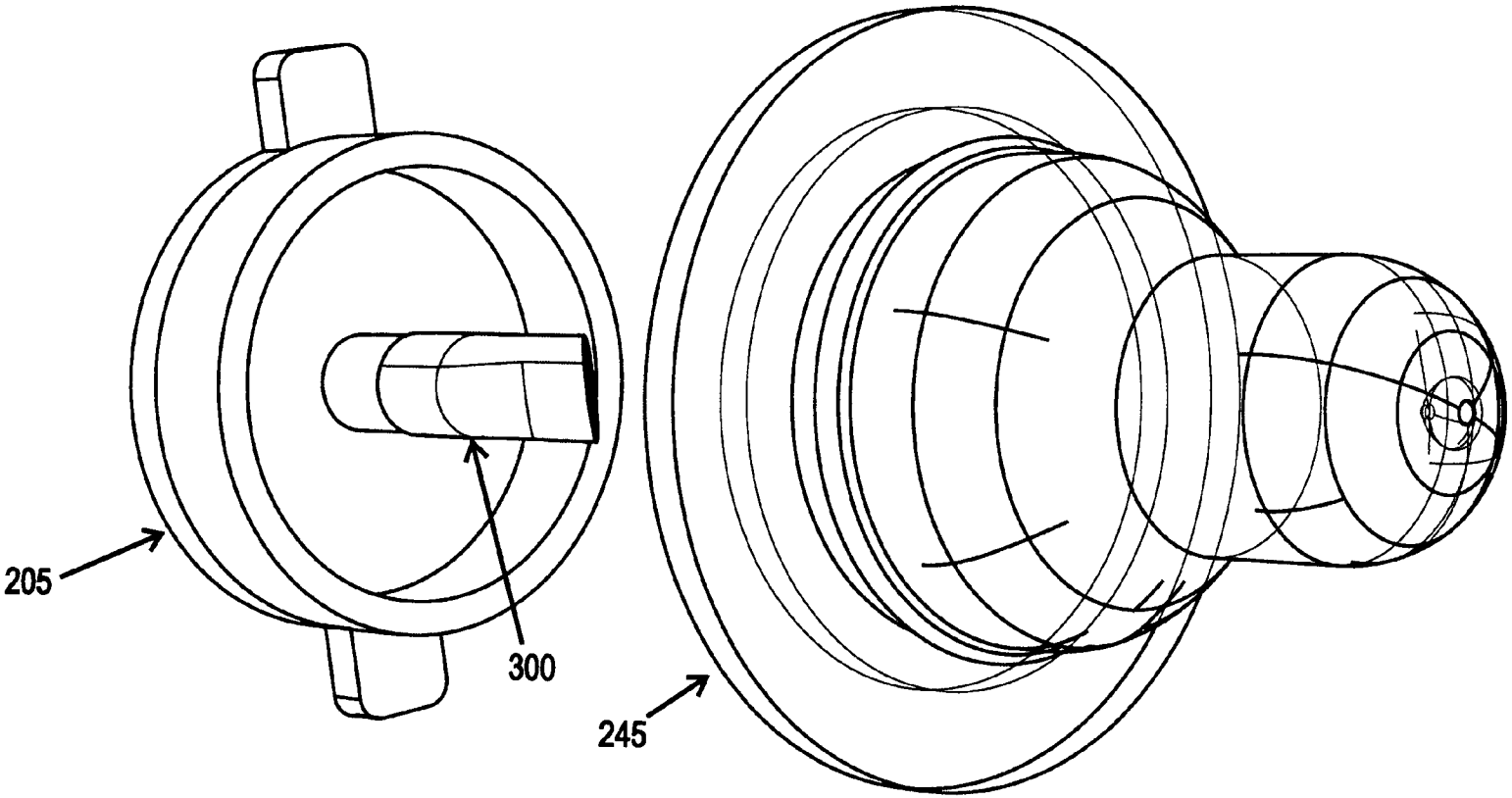
Figure 19:
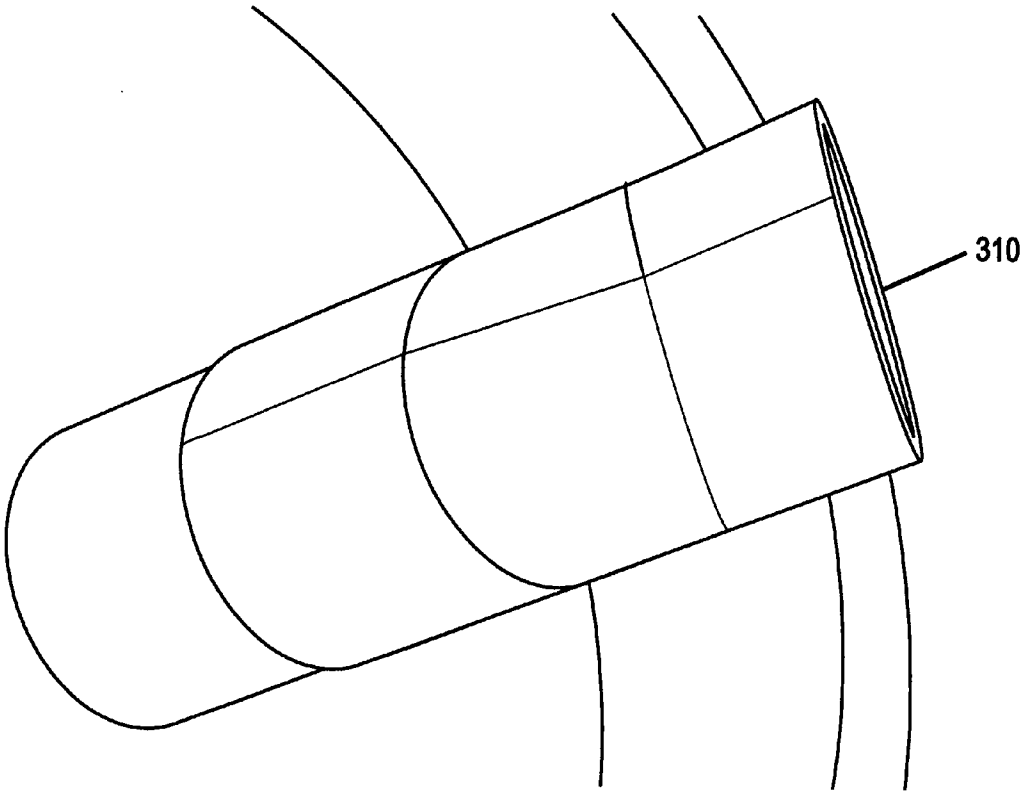
Figure 20:
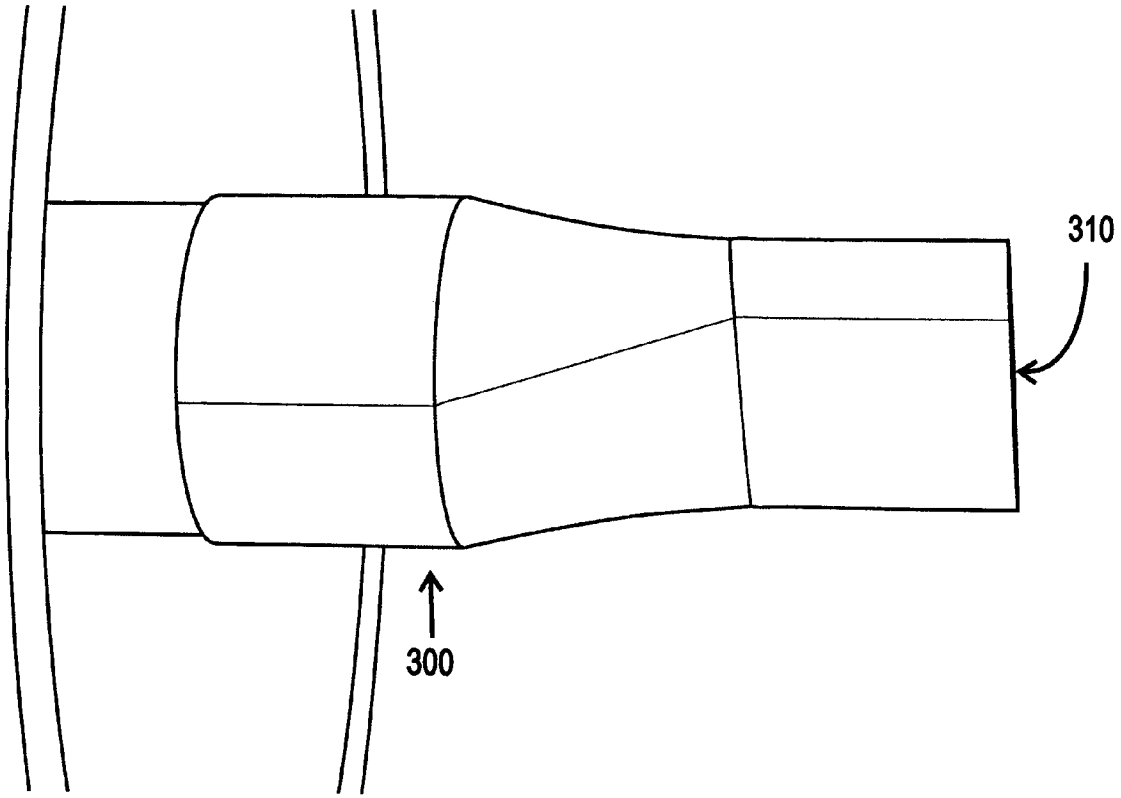
Figure 21:
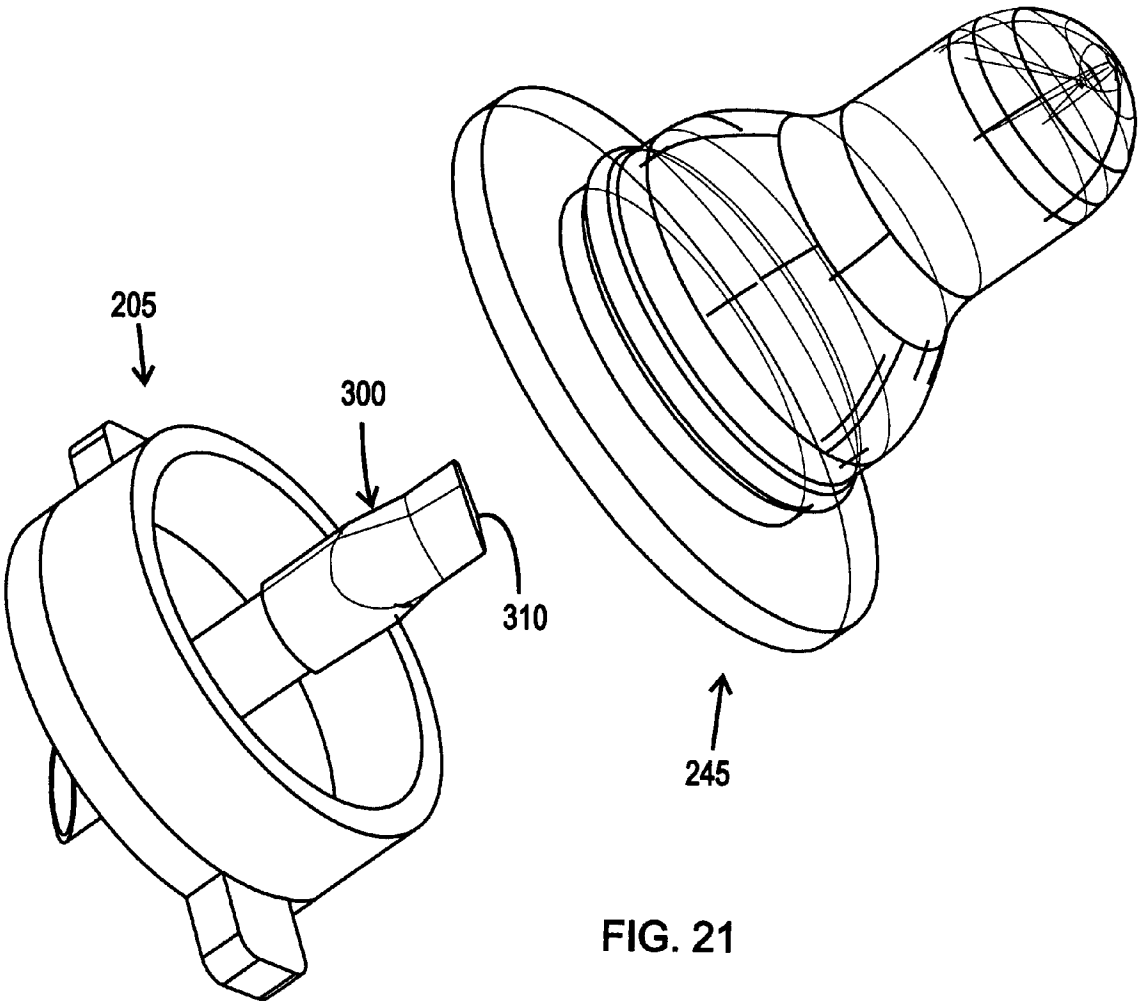
Figure 22:
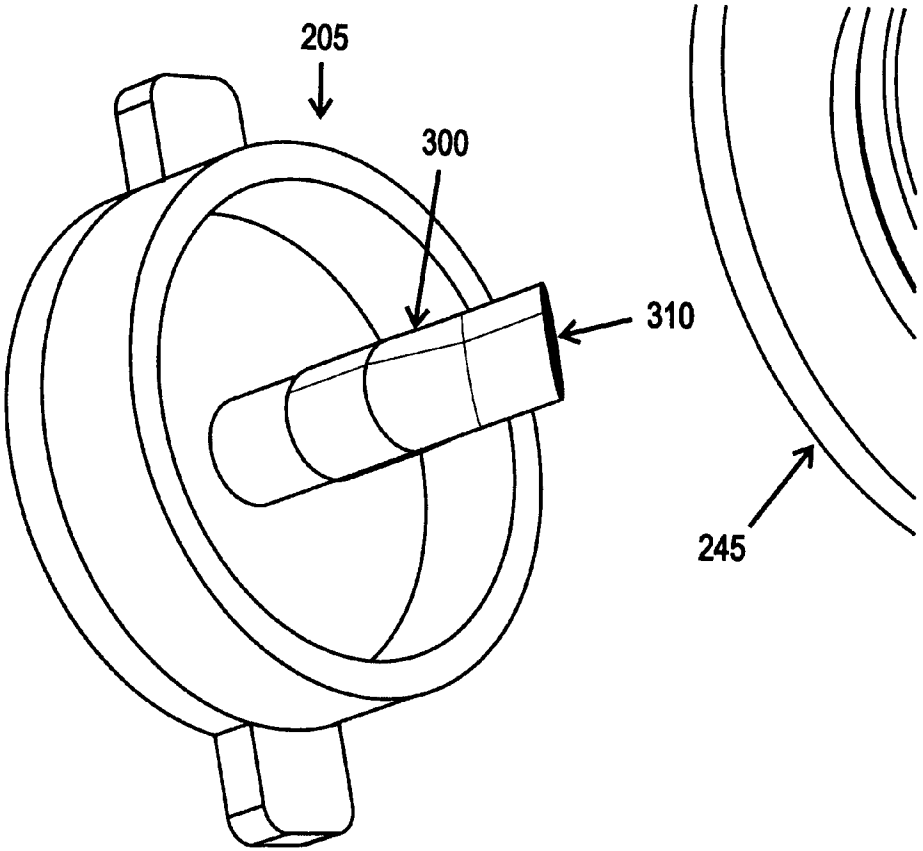
Figure 23:
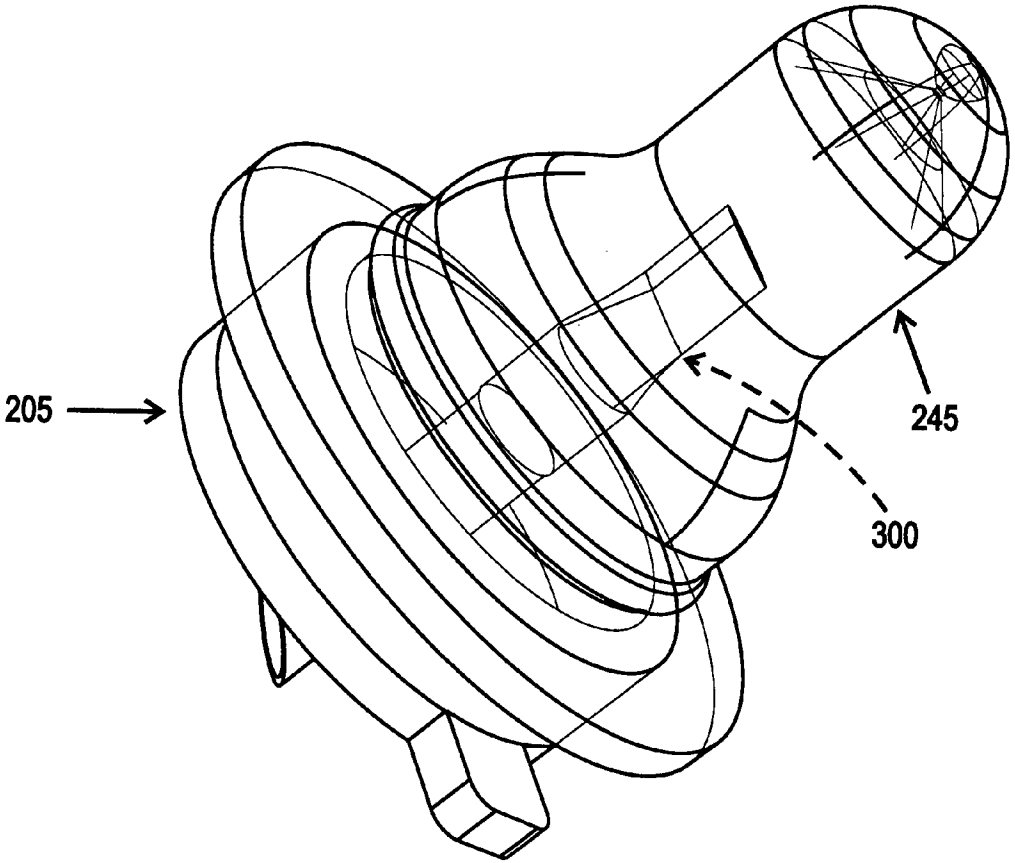
Figure 24:
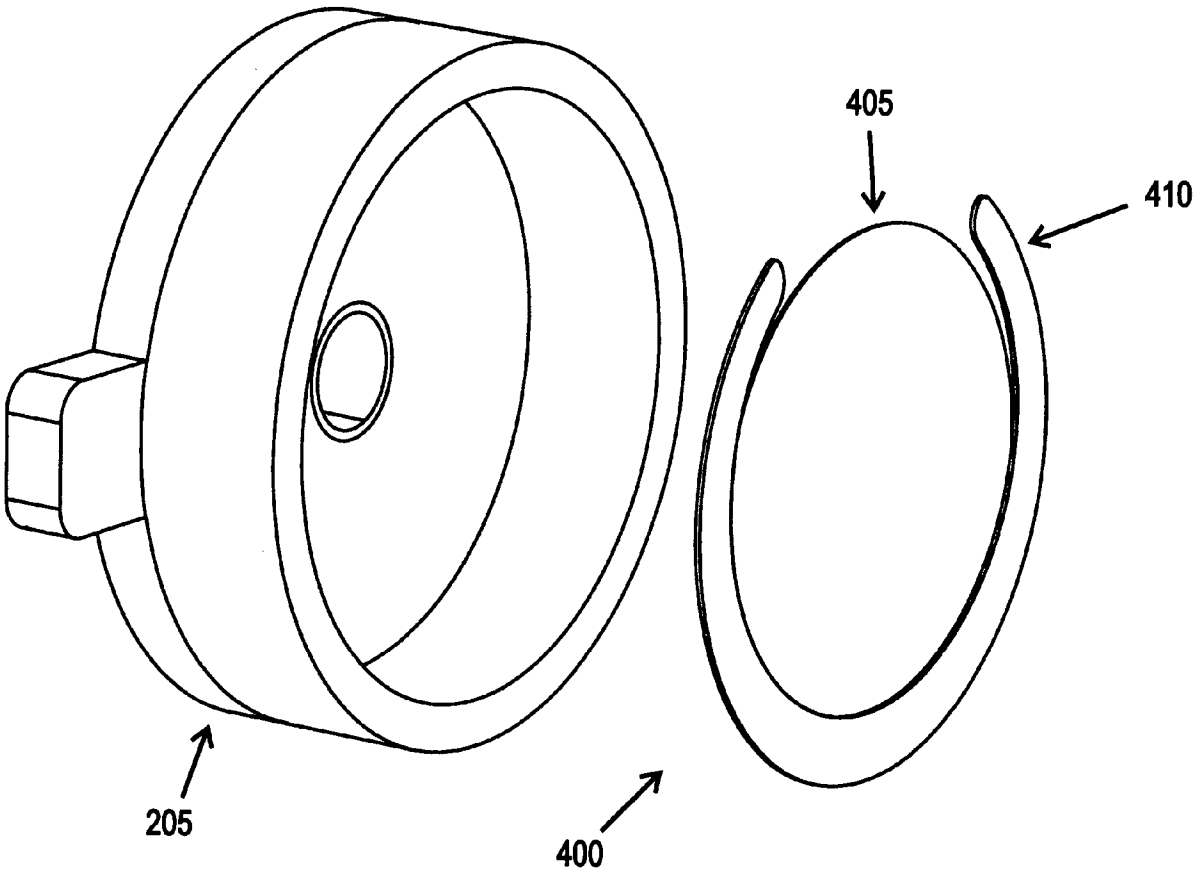
FIGS. 24-27 are a series of views showing an alternative form of baby nipple assembly incorporating a reed-type valve.
Figure 25:
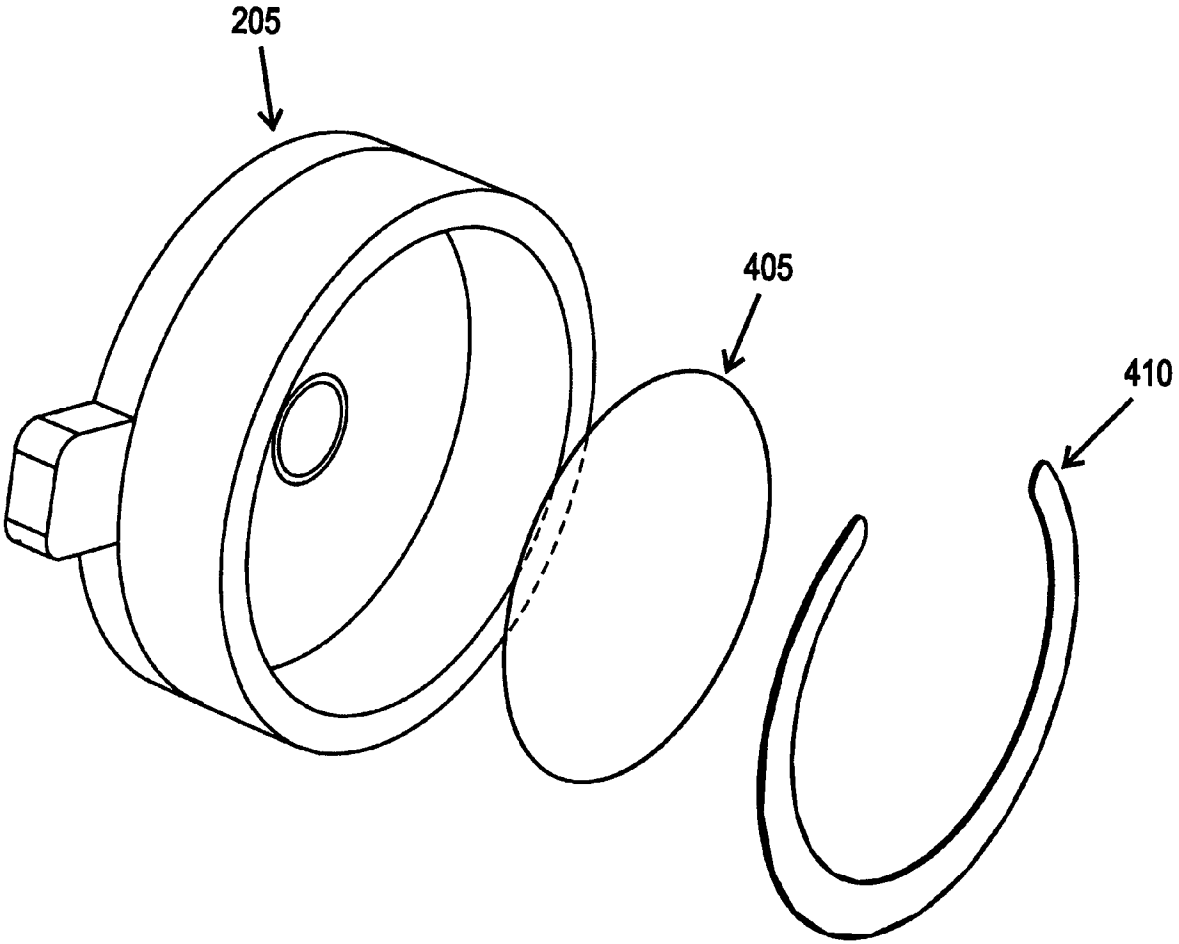
Figure 26:
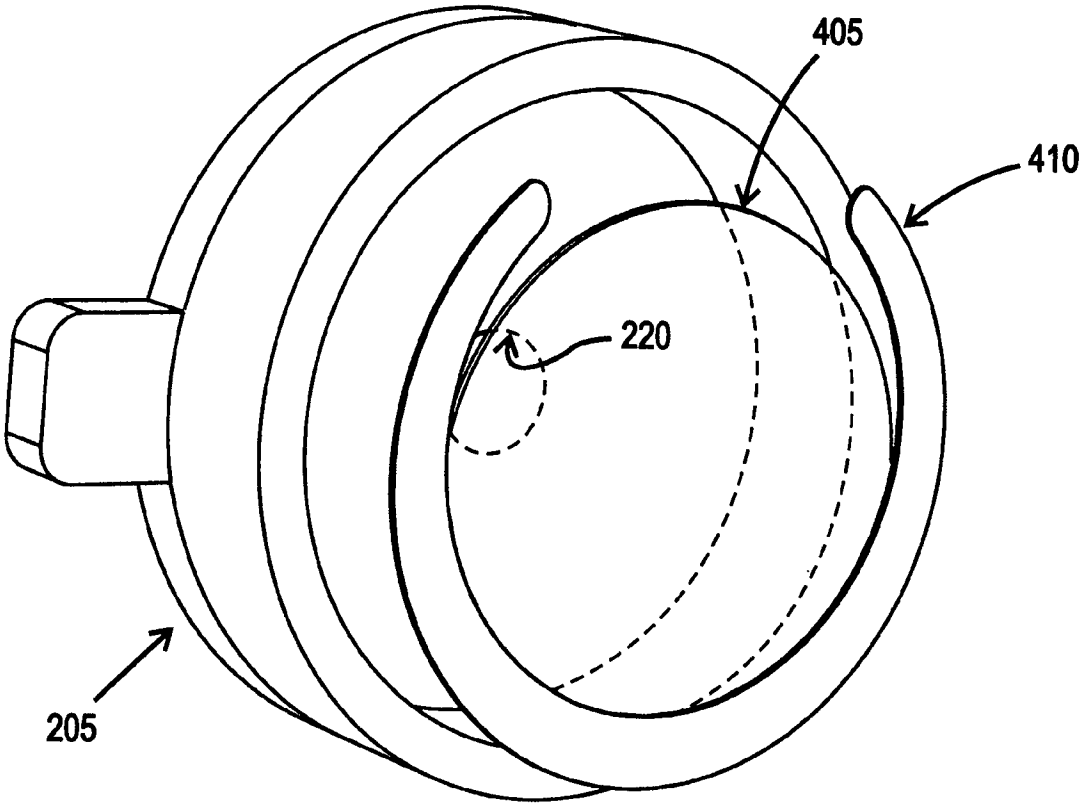
Figure 27:
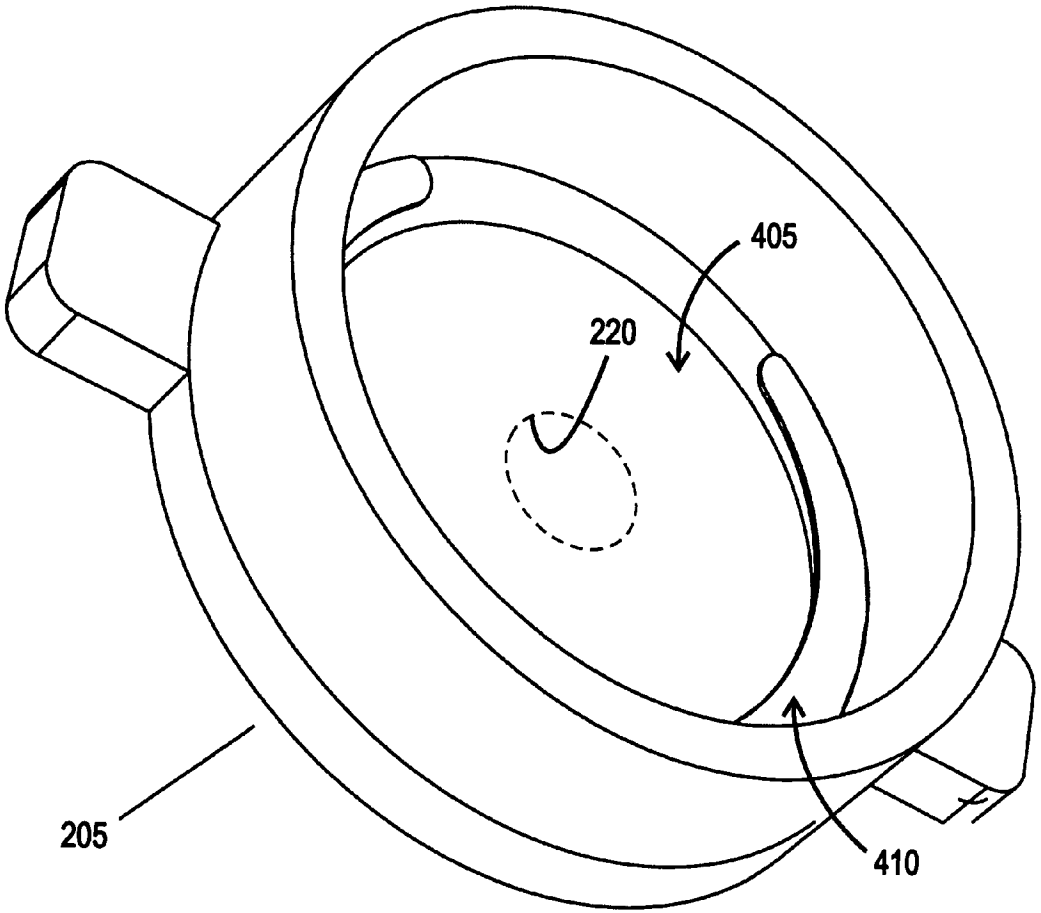
Figure 28:
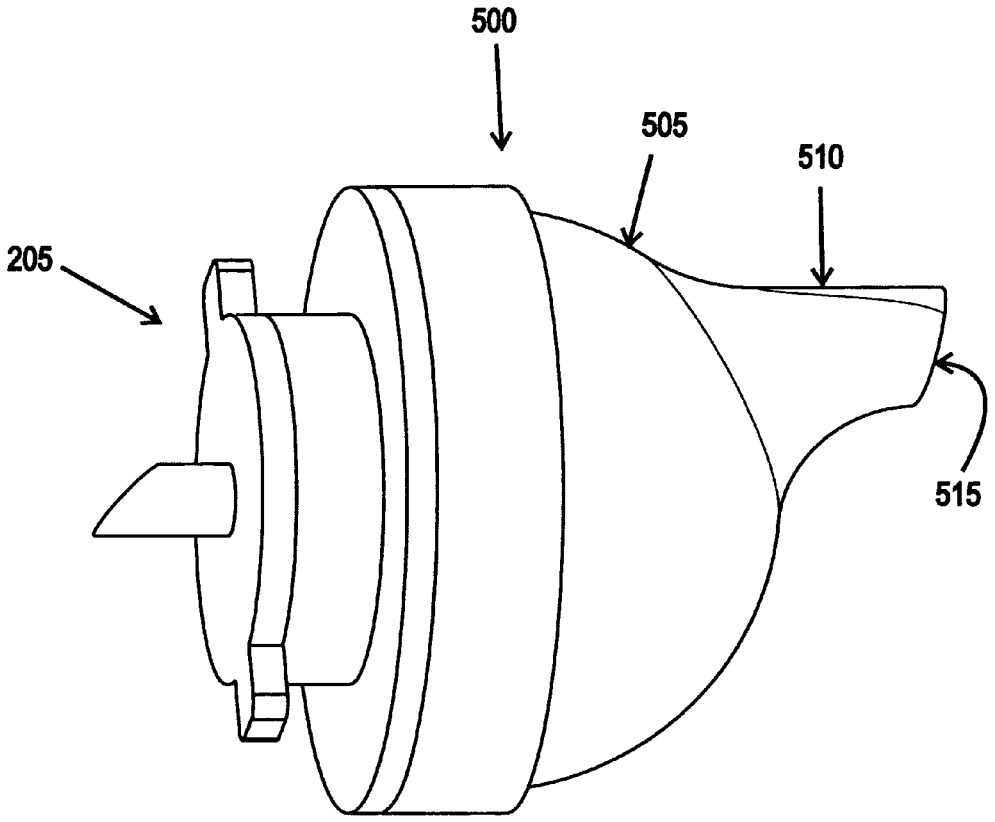
FIGS. 28-31 are a series of views showing an alternative form of the invention incorporating a "sippy spout" drinking element.
Figure 29:
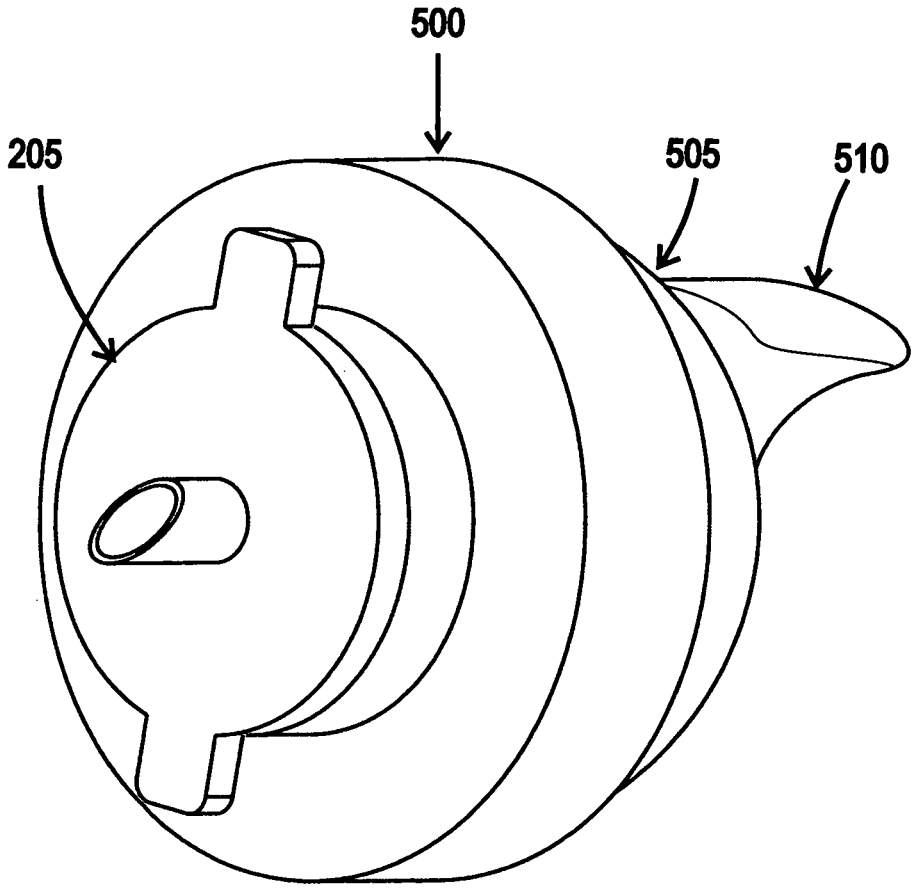
Figure 30:
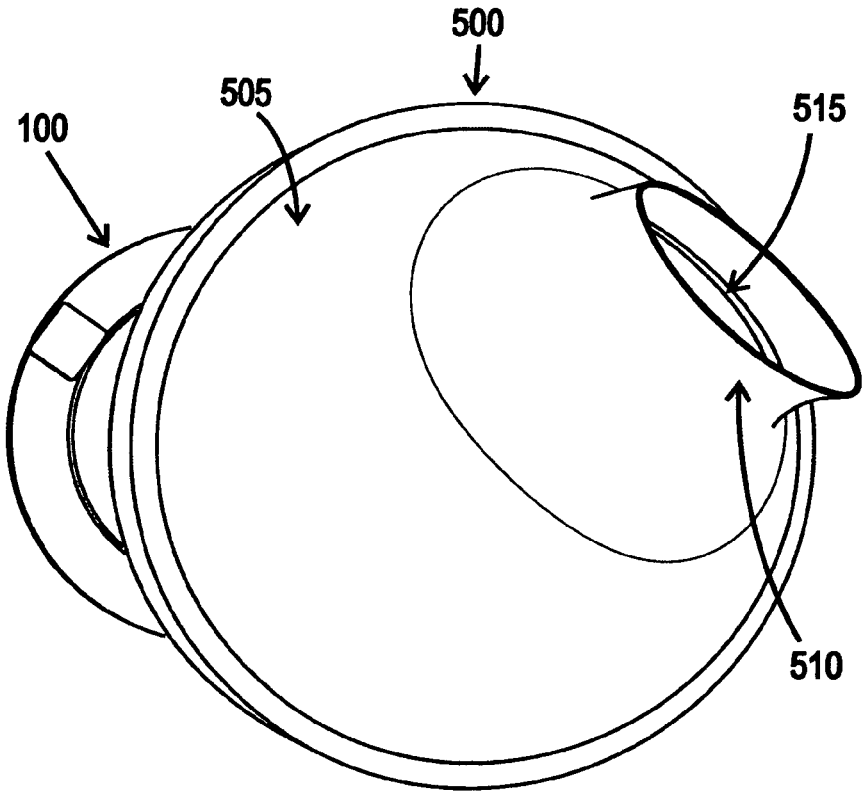
Figure 31:
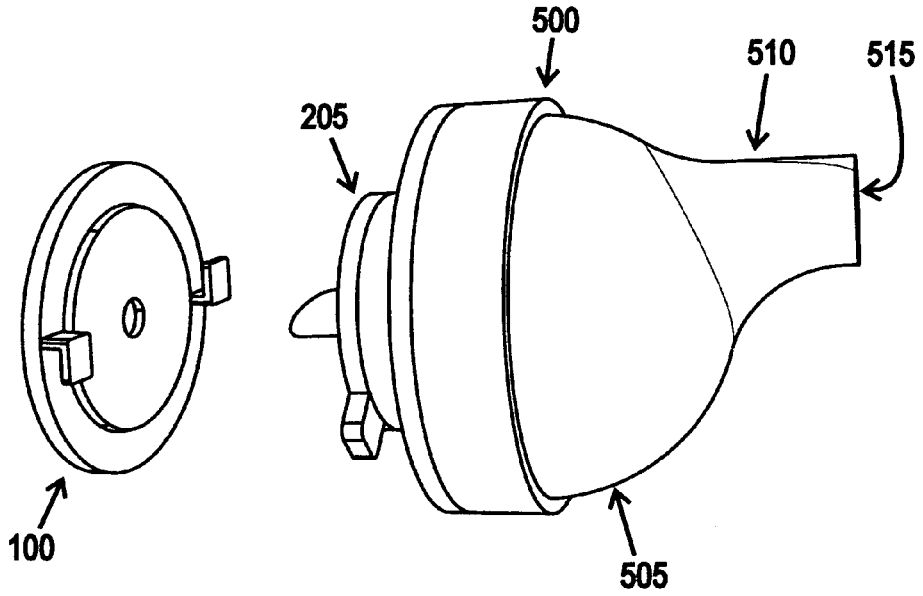

Next, nipple subassembly 200 is secured to mount subassembly 100 (FIGS. 13-15). This is done by pressing the rear side of nipple subassembly 200 against the front side of mount subassembly 100. As this occurs, the sharp rear end of tube 225 punctures the side wall of flexible drink pouch 10, thereby placing the interior of nipple 250 in fluid communication with the interior of flexible drink pouch 10. Thus, the juice or other beverage contained within flexible drink pouch 10 can flow into nipple 250. Then nipple subassembly 200 is rotated so as to slip nipple flanges 240 beneath mount flanges 140, thereby locking nipple subassembly 200 to mount subassembly 100 (FIG. 16). The flexible drink pouch 10 may then be handed to a baby or toddler so that the beverage contained within the flexible drink pouch 10 can be suckled by the child using nipple 250.

During drinking, the side walls of flexible drink pouch 10 can contract as the beverage is withdrawn, so as to ensure that fluid is constantly supplied to nipple 250, regardless of the orientation of nipple 250. Furthermore, the flexible side walls of drink pouch 10 permit the child to also squeeze flexible drink pouch 10 so as to force fluid into nipple 250.

Thereafter, when the child is finished drinking, the nipple subassembly 200 can be removed from the mount subassembly 100, the mount subassembly 100 and flexible drink pouch 10 can be discarded, and the nipple subassembly 200 cleaned (e.g., by boiling in water). The cleaned nipple subassembly 200 may thereafter be used on a subsequent occasion to drink from another flexible juice pouch 10, using a fresh mount subassembly 100.

In some circumstances it may be desirable to provide a one-way valve between the interior of flexible drink pouch 10 and the interior of nipple 245, in order that air will be prevented from passing into the interior of the flexible drink pouch 10.

By way of example but not limitation, and looking now at FIGS. 16A-23, the tube 225 of nipple subassembly 200 may extend out the front side 210 of body 205, and a Heimlich-type valve 300 may be provided at the front end of tube 225. Valve 300 is a one-way valve and essentially comprises a rubber tube 305 that ends in a slit 310. When the pressure on the tube end is greater than on the slit end, fluid can readily travel through the tube and out the slit. However, when the pressure on the slit end is greater than the pressure on the tube end (or, in the present case, when pressure on the tube end is lower due to vacuum), the slit end is compressed, flattening it and obstructing the tube. Thus, valve 300 is a one-way valve that permits fluid to leave the interior of flexible drink pouch 10 but prevents air from entering it.

Other types of one-way valves may be used in place of the Heimlich-type valve 300 shown in FIGS. 16A-23.

By way of example but not limitation, and looking now at FIGS. 24-27, there is shown a reed-type valve 400 which mounts to the front side of body 205. More particularly, reed-type valve 400 comprises a flat, flexible membrane 405 which is held in place by a locking C-ring 410 which extends along approximately 180-270 degrees of the circumference of membrane 405. When the pressure is lower on the nipple side than on the pouch side, the membrane 405 bends open and fluid is allowed to flow out to the nipple. However, when pressure is greater on the nipple side, membrane 405 closes off the opening 220 in the body 205, thus preventing air from entering the interior of the juice pouch.

Still other types of one-way valves (sometimes referred to as "check valves") may be used in conjunction with the present invention.

It should also be appreciated that the present invention is not limited to use with baby nipples per se. More particularly, when viewed in a broader context, it will be appreciated that the present invention provides a way to mount a reusable drinking element (e.g., a baby nipple in the constructions discussed above) to a single use drink pouch by means of a disposable mount which (i) attaches to the flexible drink pouch and (ii) receives the drinking element. The particular drinking element can vary according to the application.

Thus, for example, the nipple constructions described above can be replaced by a so-called "sippy spout" construction such as that shown in FIGS. 28-31. More particularly, in this construction, the nipple 245 is replaced by a sippy spout 500 which comprises a shell 505 having a mouthpiece 510 including an opening 515. With this construction, the user (e.g., a toddler) sucks on the mouthpiece 510 to receive the beverage through opening 515. It will be appreciated that with the sippy spout construction, it will generally be desirable to incorporate a one-way valve into the design in order to (i) prevent air from entering the flexible drink pouch, and (ii) prevent fluid from accidentally spilling out opening 515.

Still other types of drinking elements can be substituted for nipple 245. By way of example but not limitation, a drinking tube (e.g., such as the sort used by bikers and runners) can be connected to the drink pouch via the disposable mount.

It should also be appreciated that, just as the range of drinking element can vary according to the application, so too the range of users can vary. Thus, for example, with the nipple construction the user might be an infant or a toddler; with the sippy spout construction, the user might be a toddler or a disabled person; with the drinking tube construction, the user might be a biker or runner, etc.

Thus, it will be appreciated that the present invention provides apparatus for facilitating beverage dispensing from disposable beverage containers and these specific constructions employed may vary according to the particular application involved.

In a preferred embodiment, the apparatus consists of a disposable dock or platform that can be attached by way of adhesive or other means to a commercially available disposable beverage container that in turn enables one to attach a nipple or other appliance in a watertight fashion. In a preferred embodiment, a reusable subassembly that incorporates a reusable nipple is attached, by way of a disposable disk, to a Mylar juice pack.

A variety of drinking appliances may be attached to a disposable dock. These include, but are not limited to, straws, spill proof nozzles, athletic friendly nozzles, and appliances to facilitate beverage consumption by an invalid.

The disposable element (i.e., the disk) can be made of plastic, paper, metal, or any other material. It can attach to the disposable beverage container by means of adhesive, prongs, hooks, expanding geometry, magnets, glue, or other means. The disposable disk element may incorporate a mechanism that locks to the reusable appliance by way of a bayonet mechanism, hook-and-eye Velcro-like mechanism, or any other geometric interaction. Alternatively the two elements, disposable and reusable, may also affix to one another by means of magnetism or adhesive.

In an alternative embodiment, a special disposable juice container may incorporate the dock element. This special container is used with the reusable element, be it nipple, spill proof nozzle, or other appliance.

In preferred embodiments, the disposable dock (i.e., the disk) can be attached to any number of different disposable beverage containers including, but not limited to, Mylar juice bags, plastic juice bags, paper juice bags, cardboard juice boxes, plastic juice, boxes, and any variety of plastic bottle or glass bottle. Similarly, any of these disposable juice containers may be modified in such a way as to be manufactured with the docked element included in its construction. This container could be a bag, box, cylinder, jar, or other vessel made of plastic, metal, glass, paper, or other material.

In one embodiment, disposable containers containing the docked element may be loaded by the consumer with the beverage of choice and sealed. This would allow the consumer to package formula, breast milk, or other beverages as they see fit in a hermetically sealed, watertight, single serving package that is capable of being readily transported. The dock incorporated into the wall of the container allows the reusable element, be it nipple, spill proof nozzle, or other appliance, to be attached a watertight fashion at a later time for consumption.

Figure 32:
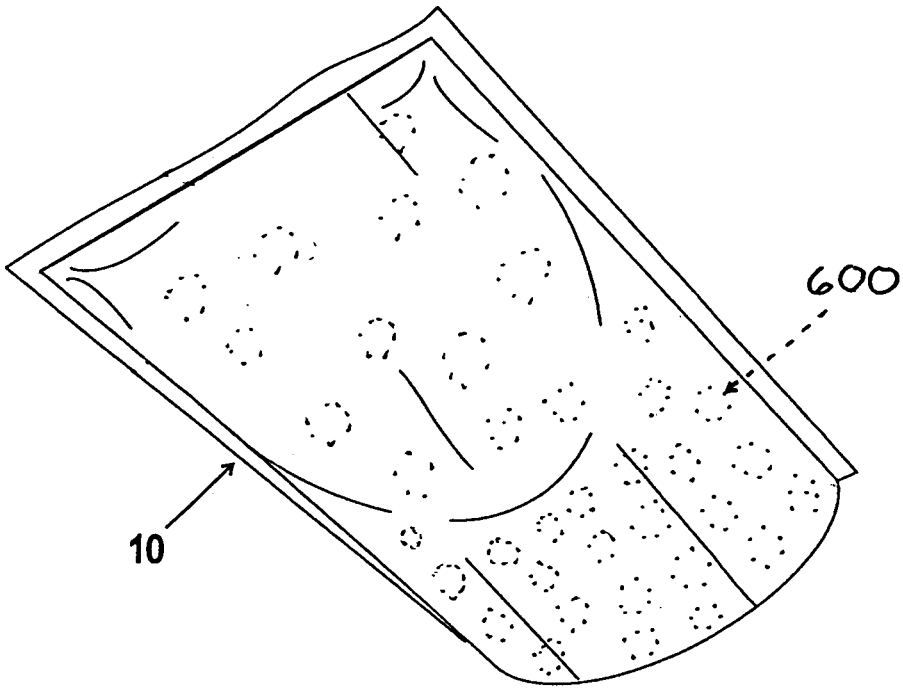
FIG. 32 is a perspective view showing a flexible drink pouch comprising at least one of a fluid, a solid, a powder or a medication.

Furthermore, flexible drink pouch 10 may comprise at least one compartment comprising at least one of a fluid, a solid, a powder or a medication. See, for example, FIG. 32 which illustrates a flexible drink pouch 10 comprising at least one compartment comprising at least one of a fluid, a solid, a powder or a medication 600.

In one embodiment, a disposable container designed specifically for formula or breast milk has a liquid crystal display incorporated into the wall as an indicator to insure that the contents were at an appropriate temperature.

In another embodiment, a disposable two-compartment container contains water and formula powder in separate pouches in such a way that the septum separating the components may be ruptured by externally squeezing the bag, thereby allowing the formula to be mixed, immediately prior to consumption, in a sterile hermetically sealed disposable container. This two-compartment container may also contain a liquid crystal display and a dock for attaching a reusable nipple as described above.

In a slightly different embodiment, a two-compartment disposable bag with a dock-like feature may come prepackaged with formula powder in one of the compartments. The consumer would fill the second compartment with water prior to sealing the disposable package. This would allow the disposable bag containing the formula powder to be readily transported without refrigeration in a compact geometry. Prior to using the formula, the second compartment would be filled with water and sealed. Subsequently the bag would be squeezed externally, allowing the mixing of formula powder and water. A liquid crystal display incorporated into the wall of the disposable bag would register the temperature of the contents. A reusable appliance such as a high-quality nipple could be attached to the dock feature incorporated into the bag wall. Alternatively, a disposable dock could be attached to the beverage container as described earlier.

Similarly, a two-compartment disposable bag may contain a drink powder in one compartment and water in the second. The disposable bag may be mixed by externally squeezing as described above. The bag may be pre-filled with drink powder and water or alternatively, would allow the consumer to place drink powder and/or water in one or both compartments. The disposable bag may be constructed to allow mixing of the two compartments when externally squeezed as described above. Alternatively, a reusable two-compartment bag may be constructed to allow mixing of the two compartments when actuated, but to be used again, maintaining isolation between the two compartments until actuated again. This two-compartment bag, whether disposable or reusable, may have a dock feature molded into its well. Alternatively the disposable dock could be attached to the bag as described above. As described above, juice powder may come prepackaged in one of the compartments to facilitate transporting and storing the product. Water would be added to the second compartment immediately prior to sealing the bag and rupturing the septum. After reconstituting the juice, a reusable drinking appliance may be affixed to a dock incorporated into the bag structure. Alternatively a disposable dock may be attached to the bag as described above to allow a reusable appliance to be attached.

In another embodiment, a disposable container may contain antibiotic or other medications in a powdered form to be admixed with water as described above to generate a specific dose of a desired medication. The dose of medicine so prepared may then be attached by means of an incorporated dock (or attached dock) to a reusable nipple complex to allow administration of antibiotics on a precise basis to an infant or toddler.

In an additional embodiment, the nipple, spill proof nozzle, straw, athlete friendly appliance, or invalid friendly appliance, may be attached to a disposable beverage container without the need for disposable dock or interface. In this embodiment, a mechanism integral to the reusable component allows it to puncture and seal to the disposable containers without need for the dock. The reusable component may achieve this through a combination of threads, pins, magnets, expanding geometry, Molly-type struts, or other configurations.

In still another embodiment, the nipple, spilt proof nozzle, straw, athlete friendly appliance, or invalid friendly appliance may be disposable and require no additional interface to attach to the disposable beverage container. The disposable appliance may achieve this as described above through a combination of threads, pins, magnets, expanding geometry, Molly-type struts, or other configurations. In one possible iteration, screw type threads of a progressively decreasing pitch may be used to allow the appliance to attach to the disposable beverage container in a watertight fashion. Tightening or turning the appliance would pinch the container material between the last threads which, in a progressively decreasing pitch, would be extremely close together. By expanding geometry, what is meant is any configuration that could puncture the bag or other disposable beverage container, thereafter expand within the inside of the bag and push up against the inner surface, creating a watertight seal.

In still another embodiment of the present invention, the dock is disposable and contains the puncture means to create a hole in the disposable juice bag, box, or other container. In this iteration, the dock is attached to the disposable beverage container, the reusable appliance is attached to the dock in a reversible away, and the dock mechanism is actuated perforating the disposable beverage container. The perforation mechanism may consist of a small spike or pin that is positioned above the hole in the dock and only extends through the hole when actuated by applying pressure to a spring mechanism. The dock is positioned on the disposable beverage container in such a way that the hole in the dock is in alignment with the perforation site on the disposable beverage container.

In a preferred embodiment, the dock has no moving parts and would consist simply of a plastic disk with a hole in the center and adhesive on the back. Molded into the plastic disk are geometric features that will allow it to lock reversibly to the reusable appliance in a watertight fashion. The reusable appliance has, integral to its construction, a beveled tube or spike that would puncture the disposable beverage container as the appliance was attached the disposable dock. The dock is attached to the disposable beverage container so that the hole in the center of the disposable dock is in alignment with the site of intended perforation of the disposable beverage container. In a preferred embodiment, the geometric features on the disposable dock comprise recesses, slots, holes, catches, latches, or ribs that are engaged by geometric features of the reusable appliance. The features on the reusable appliance may comprise wings, tabs, pins, hooks, barbs, ribs, slots or other features that engage or interact with the features on the disposable dock to effect a robust mechanical fixation and a watertight seal.

In a preferred embodiment, the reusable appliance integrates with pre-existing nipple technology. A number of nipples currently exist on the market that have been engineered to optimize feeding characteristics. These are generally held to the top of a baby bottle by a threaded retaining ring. In a preferred embodiment of an infant feeding appliance, the reusable portion may attach, by means of threads, to a commercially available nipple and retaining ring construct. In a preferred embodiment, the reusable portion can be disassembled by removing the retaining ring and nipple to facilitate washing the appliance in a dishwasher.

In another embodiment, a reusable beverage container can be repeatedly filled with a beverage of choice and sealed in a watertight fashion. This reusable container has, integral to its construction, a dock that allows the appliance to be attached in a robust and watertight fashion. The dock may be constructed that it will seal reversibly when the appliance is removed. This allows the appliance to be attached and removed several times while maintaining a watertight container filled with beverage.

In still another embodiment, the reusable appliance, whether it is a nipple complex, sippy-cup attachment, or other enabling device to facilitate drinking, is connected to a long tube, straw, or flexible pipe that is introduced into the juice bag, box, or other disposable or reusable container to allow juice to be withdrawn from the lower, gravity dependent portion of the container.

Still other variations of the present invention will be apparent to a person skilled in the art in view of the present disclosure.

What is claimed is:

1. A drink assembly comprising:

a mount subassembly for attachment to a pre-existing flexible drink pouch, the mount subassembly comprising a body having a proximal side and a distal side and an opening extending from the proximal side to the distal side, and an adhesive mounted on the distal side for affixing the mount subassembly to the flexible drink pouch; and a mouthpiece subassembly for releasable attachment to the mount subassembly, the mouthpiece subassembly comprising a mouthpiece having an opening therein, and a tube extending distally from the mouthpiece, with the interior of the tube communicating with the opening in the mouthpiece;

wherein the mouthpiece subassembly comprises a mouthpiece lock mechanism for releasably locking to a mount lock mechanism connected to the mount subassembly; and wherein the mouthpiece lock mechanism comprises at least one flange, and further wherein the mount lock mechanism comprises at least one flange mounted on a post.

2. A drink assembly according to claim 1 wherein the mouthpiece comprises a nipple.

3. A drink assembly according to claim 1 wherein mouthpiece comprises a spout.

4. A drink assembly according to claim 1 wherein the mouthpiece subassembly comprises a one-way valve.

5. A drink assembly according to claim 1 wherein the flexible drink pouch comprises at least one compartment.

6. A drink assembly according to claim 5 wherein the flexible drink pouch comprises a fluid in the at least one compartment.

7. A drink assembly according to claim 5 wherein the flexible drink pouch comprises a solid in the at least one compartment.

8. A drink assembly according to claim 7 wherein the flexible drink pouch comprises a powder in the at least one compartment.

9. A drink assembly according to claim 1 wherein the flexible drink pouch comprises a medication in the at least one compartment.

10. A drink assembly according to claim 1 wherein the flexible drink pouch comprises at least two compartments separated by a septum.

11. A drink assembly according to claim 10 wherein the flexible drink pouch comprises a material in one of the at least two compartments.

12. A drink assembly according to claim 10 wherein the flexible drink pouch comprises a first material in a first compartment and a second material in a second compartment.

13. A drink assembly according to claim 1 wherein the flexible drink pouch comprises a puncture zone for facilitated penetration by the tube.

14. A drink assembly according to claim 1 wherein the distal end of the tube comprises a point.

15. A drink assembly comprising:

a mount subassembly attached to a pre-existing flexible drink pouch, the mount subassembly comprising a body having a proximal side and a distal side and an opening extending from the proximal side to the distal side, with the distal side of the mount subassembly being fixed to the flexible drink pouch; and a mouthpiece subassembly for releasable attachment to the mount subassembly, the mouthpiece subassembly comprising a mouthpiece having an opening therein, and a tube extending distally from the mouthpiece, with the interior of the tube communicating with the opening in the mouthpiece;

wherein the mouthpiece subassembly comprises a mouthpiece lock mechanism for releasably locking to a mount lock mechanism connected to the mount subassembly; and wherein the mouthpiece lock mechanism com.rises at least one flange, and further wherein the mount lock mechanism comprises at least one flange mounted on a post.

16. A drink assembly comprising:

a mount subassembly for attachment to a pre-existing container, the mount subassembly comprising a body having a proximal side and a distal side and an opening extending from the proximal side to the distal side, and an adhesive mounted on the distal side for affixing the mount subassembly to the container; and a mouthpiece subassembly for releasable attachment to the mount subassembly, the mouthpiece subassembly comprising a mouthpiece having an opening therein, and a tube extending distally from the mouthpiece, with the interior of the tube communicating with the opening in the mouthpiece;

wherein the mouthpiece subassembly comprises a mouthpiece lock mechanism for releasably locking to a mount lock mechanism connected to the mount subassembly; and wherein the mouthpiece lock mechanism comprises at least one flange, and further wherein the mount lock mechanism comprises at least one flange mounted on a post.

* * * * *